US010976021B2

(12) United States Patent
Wang

(10) Patent No.: US 10,976,021 B2
(45) Date of Patent: Apr. 13, 2021

(54) LIGHT PROJECTING DEVICE HAVING HIGH LIGHT UTILIZATION EFFICIENCY

(71) Applicant: CHIAN YIH OPTOTECH CO., LTD., Mial-Li Hsien (TW)

(72) Inventor: Cheng Wang, Taipei (TW)

(73) Assignee: CHIAN YIH OPTOTECH CO., LTD., Mial-Li Hsien (TW)

( * ) Notice: Subject to any disclaimer, the term of this patent is extended or adjusted under 35 U.S.C. 154(b) by 0 days.

(21) Appl. No.: 16/702,910

(22) Filed: Dec. 4, 2019

(65) Prior Publication Data

US 2020/0182430 A1 Jun. 11, 2020

(30) Foreign Application Priority Data

Dec. 5, 2018 (TW) ..... 107143704

(51) Int. Cl.

| | |
|---|---|
| ***F21S 41/32*** | (2018.01) |
| ***F21S 41/148*** | (2018.01) |
| ***F21S 41/147*** | (2018.01) |
| ***F21S 41/33*** | (2018.01) |
| ***F21V 29/76*** | (2015.01) |

(Continued)

(52) U.S. Cl.

CPC ..... *F21S 41/321* (2018.01); *F21S 41/147* (2018.01); *F21S 41/148* (2018.01); *F21S 41/255* (2018.01); *F21S 41/336* (2018.01); *F21S 41/365* (2018.01); *F21S 45/47* (2018.01); *F21V 29/763* (2015.01); *F21W 2102/135* (2018.01)

(58) Field of Classification Search

CPC .. F21S 41/24; F21S 41/39; F21S 45/49; F21S 41/663; F21S 41/295; F21S 41/43; F21S 41/47; F21S 41/151; F21S 41/192

See application file for complete search history.

(56) References Cited

U.S. PATENT DOCUMENTS 10,281,104 B2 * 5/2019 Wang ..... F21S 41/147
10,557,609 B2 * 2/2020 Wang ..... F21S 41/47

FOREIGN PATENT DOCUMENTS

CN 206072926 U 4/2017
CN 207112676 U 3/2018

(Continued)

OTHER PUBLICATIONS

TWI619904, Apr. 2018, machine translation (Year: 2018).*

*Primary Examiner* — Tracie Y Green

(74) *Attorney, Agent, or Firm* — Li & Cai Intellectual Property (USA) Office

(57) ABSTRACT

A light projecting device includes a supporting unit, a first light source, a second light source, a light guiding unit and a lens. The first light source and the second light source are disposed on the supporting unit. The first light source includes a first lighting unit having a first light emitting surface. The second light source includes a second lighting unit having a second light emitting surface. The light emitting direction of the first light emitting surface is opposite to that of the second light emitting surface, and the first light emitting surface is substantially coplanar with the second light emitting surface. The light guiding unit is disposed in front of the supporting unit and the lens is disposed in front of the light guiding unit. Therefore, the light utilization efficiency of the light projecting device can be increased while satisfying requirements for miniaturization.

17 Claims, 45 Drawing Sheets

(51) Int. Cl.

| | |
|---|---|
| ***F21S 41/365*** | (2018.01) |
| ***F21S 41/255*** | (2018.01) |
| ***F21S 45/47*** | (2018.01) |
| *F21W 102/135* | (2018.01) |

(56) References Cited

FOREIGN PATENT DOCUMENTS

| | | | |
|---|---|---|---|
| TW | 201243219 | A1 | 11/2012 |
| TW | 201245609 | A1 | 11/2012 |
| TW | M478631 | U | 5/2014 |
| TW | M536321 | U | 2/2017 |
| TW | M539600 | U | 4/2017 |
| TW | 201811589 | A | 4/2018 |
| TW | I619904 | B | 4/2018 |

* cited by examiner

LIGHT PROJECTING DEVICE HAVING HIGH LIGHT UTILIZATION EFFICIENCY

CROSS-REFERENCE TO RELATED PATENT APPLICATION

This application claims the benefit of priority to Taiwan Patent Application No. 107143704 filed on Dec. 5, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a light projecting device, and more particularly to a light projecting device having high light utilization efficiency which can be applied to a light source for vehicles.

BACKGROUND OF THE DISCLOSURE

The headlight, referred to by some as the "eyes" of a vehicle such as a motorcycle or a car, is very important to traffic safety. Common light sources for the headlight include halogen lamps, tungsten halogen lamps and HID (High Intensity Discharge Lamp) lamps. In addition, the technologies that use an LED in place of a halogen, tungsten halogen or HID lamp become more and more popular.

For example, Taiwan Patent No. M539600 and Taiwan Patent No. M536321 disclose light core structures that can be directly mounted on a vehicle headlight. The light core structure of the '600 patent uses an LED lighting unit to directly emit lights to a lens, so as to produce a low beam illumination pattern. In addition, the light core structure of the '600 patent uses another LED lighting unit working with a reflecting structure of the vehicle headlight to output lights, in which the reflecting structure has a paraboloid-like surface, so as to produce a high beam illumination pattern. The light core structure of the '321 patent includes two LED lighting units (i.e., first and second lighting units) and a reflecting structure. The first lighting unit works with the reflecting structure to project lights to a lens, so as to produce a low beam illumination pattern. The second lighting unit works with another reflecting structure of the vehicle headlight to output lights, in which the another reflecting structure has a paraboloid-like surface, so as to produce a high beam illumination pattern.

However, the optical designs of the light core structures cannot fully utilize lights of the LED lighting unit, and thus there is a concern that the light intensity of the low beam or high beam lights is insufficient. Although the light intensity can be increased by increasing the number of the LED lighting unit, this cannot meet the design requirements of miniaturization.

SUMMARY OF THE DISCLOSURE

In response to the above-referenced technical inadequacies, the present disclosure provides a light projecting device having high light utilization efficiency.

In one aspect, the present disclosure provides a light projecting device having high light utilization efficiency which includes a supporting unit, a first light source, a second light source, a light guiding unit and a lens. The first light source is disposed on the supporting unit and includes at least one first lighting unit and a first reflecting unit corresponding in position to the at least one first lighting unit, wherein the at least one first lighting unit has a first light emitting surface. The second light source is disposed on the supporting unit and includes at least one second lighting unit and a second reflecting unit corresponding in position to the at least one second lighting unit, wherein the at least one second lighting unit has a second light emitting surface. The light guiding unit is disposed in front of the supporting unit to guide lights projected from the first light source and the second light source to the lens. The lens is disposed in front of the light guiding unit to allow lights passing through the light guiding unit to project outwardly, so as to produce a high beam or low beam illumination pattern. The light emitting direction of the first light emitting surface is opposite to that of the second light emitting surface, and the first light emitting surface is substantially coplanar with the second light emitting surface.

One of the advantages of the present disclosure is that the light projecting device, in which the light emitting direction of the first light emitting surface is opposite to that of the second light emitting surface and the first light emitting surface is substantially coplanar with the second light emitting surface, can have high light utilization efficiency while satisfying requirements for miniaturization.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
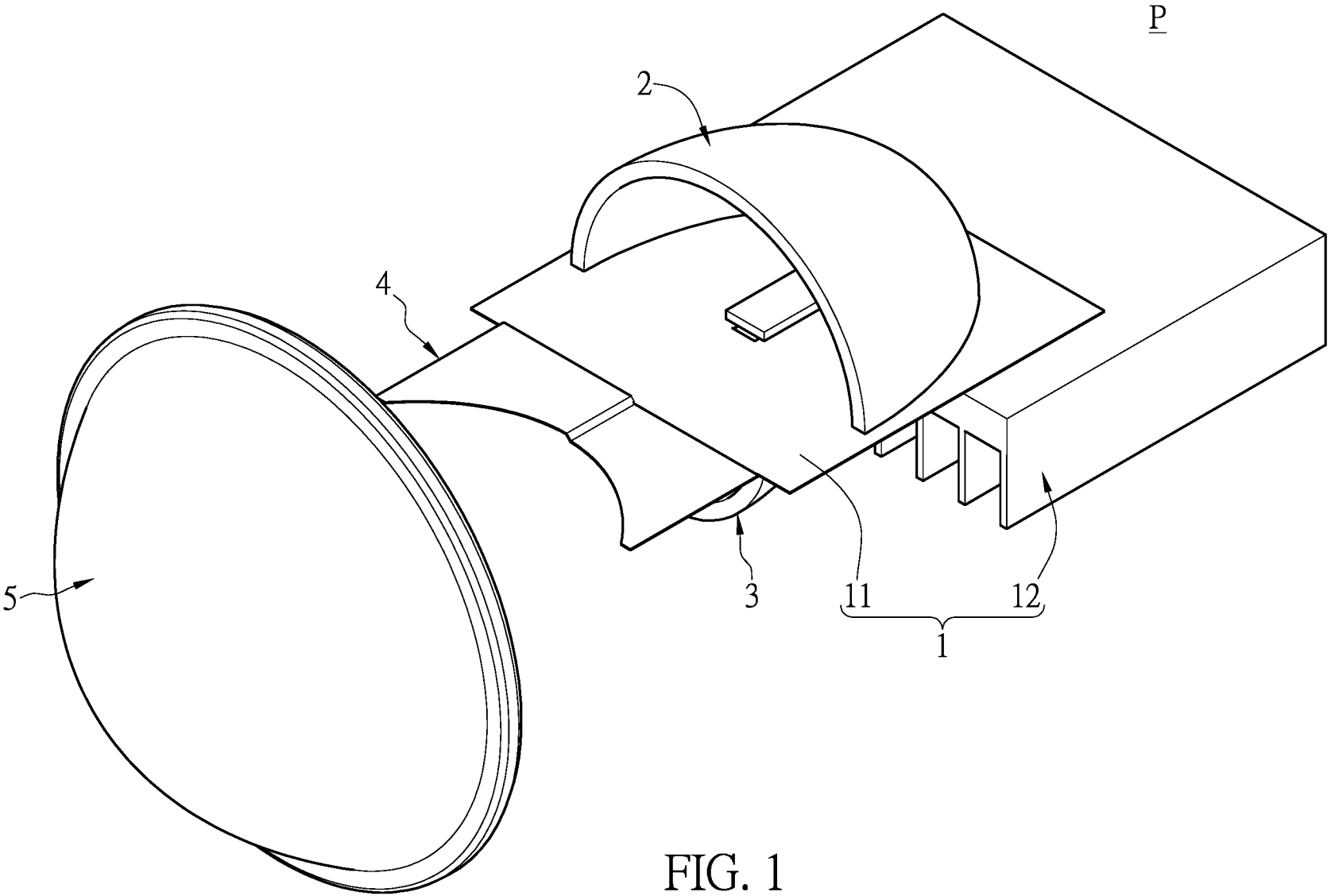
FIG. 1 is an assembled perspective view of a light projecting device having high light utilization efficiency according to a first embodiment of the present disclosure.
Figure 2:
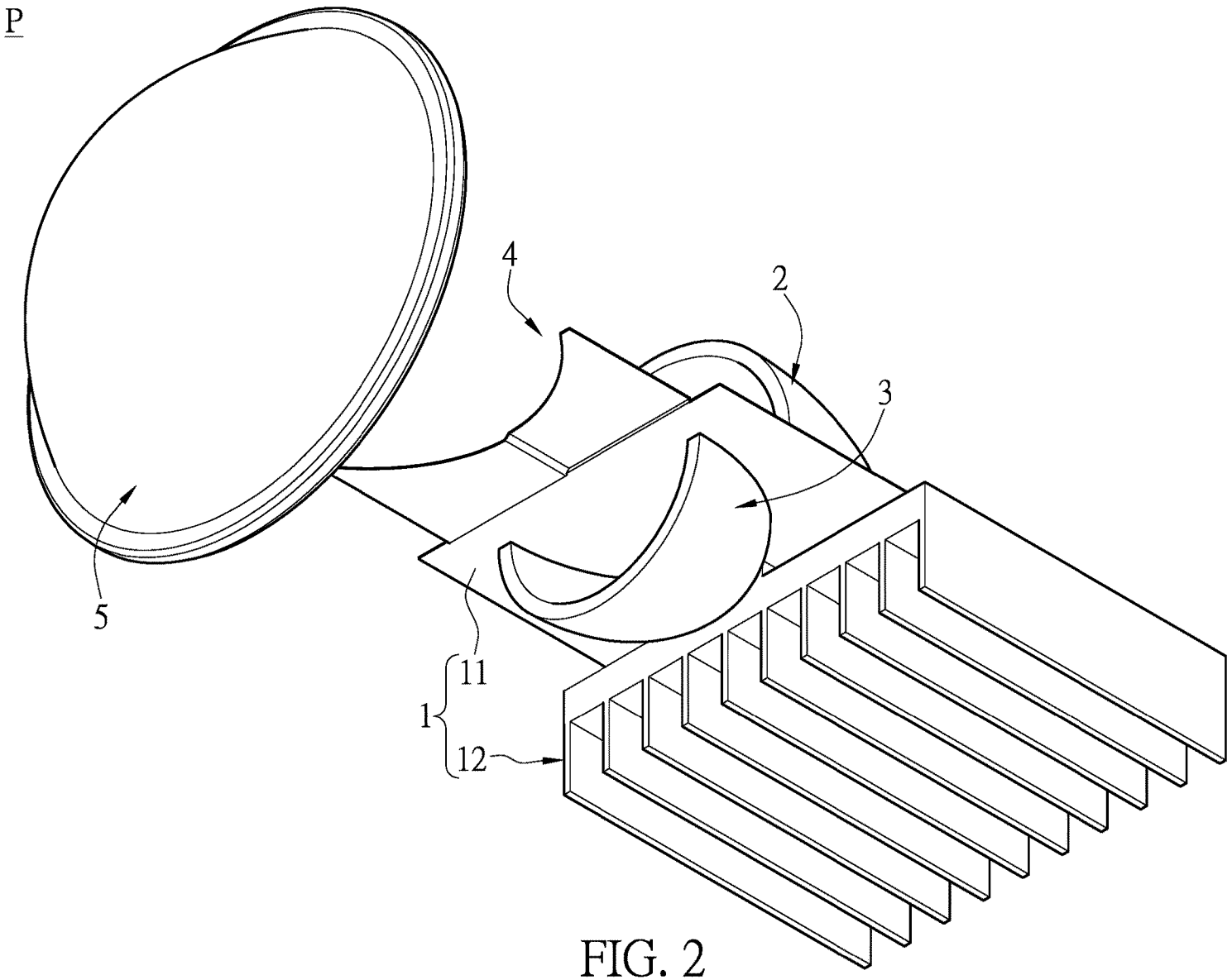
FIG. 2 is another assembled perspective view of the light projecting device according to the first embodiment of the present disclosure.
Figure 3:
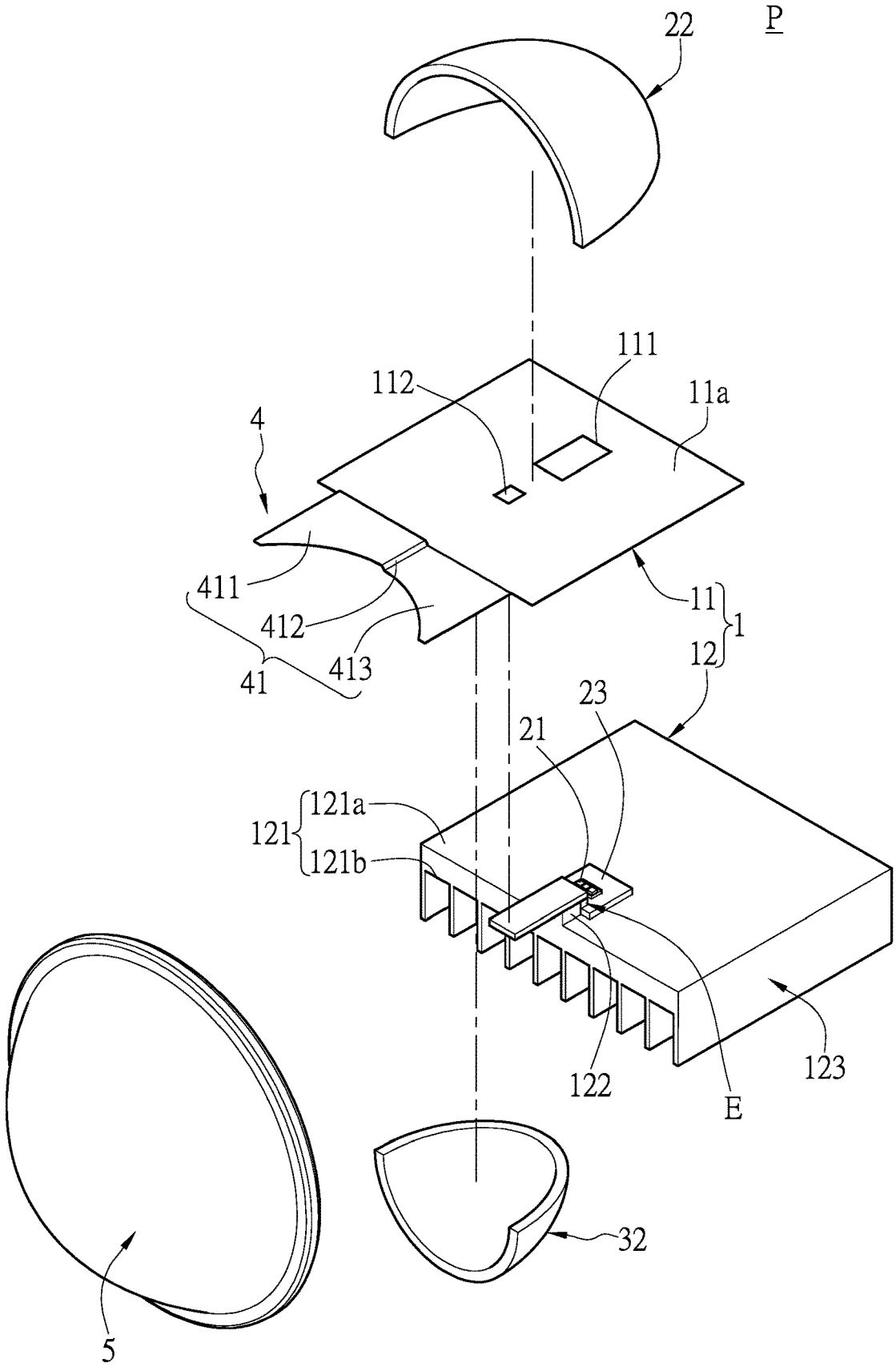
FIG. 3 is an exploded perspective view of the light projecting device according to the first embodiment of the present disclosure.
Figure 4:
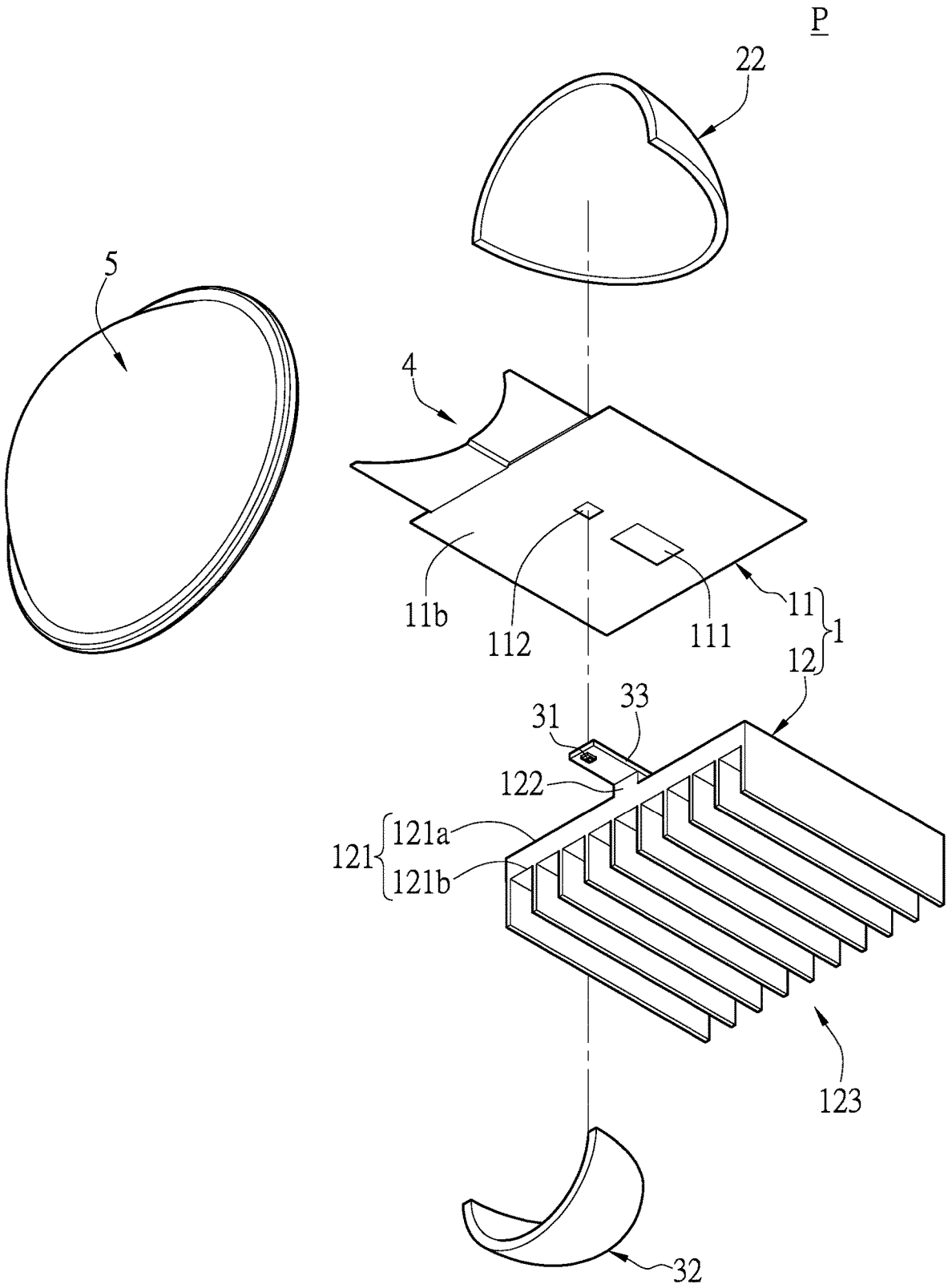
FIG. 4 is another exploded perspective view of the light projecting device according to the first embodiment of the present disclosure.
Figure 5:
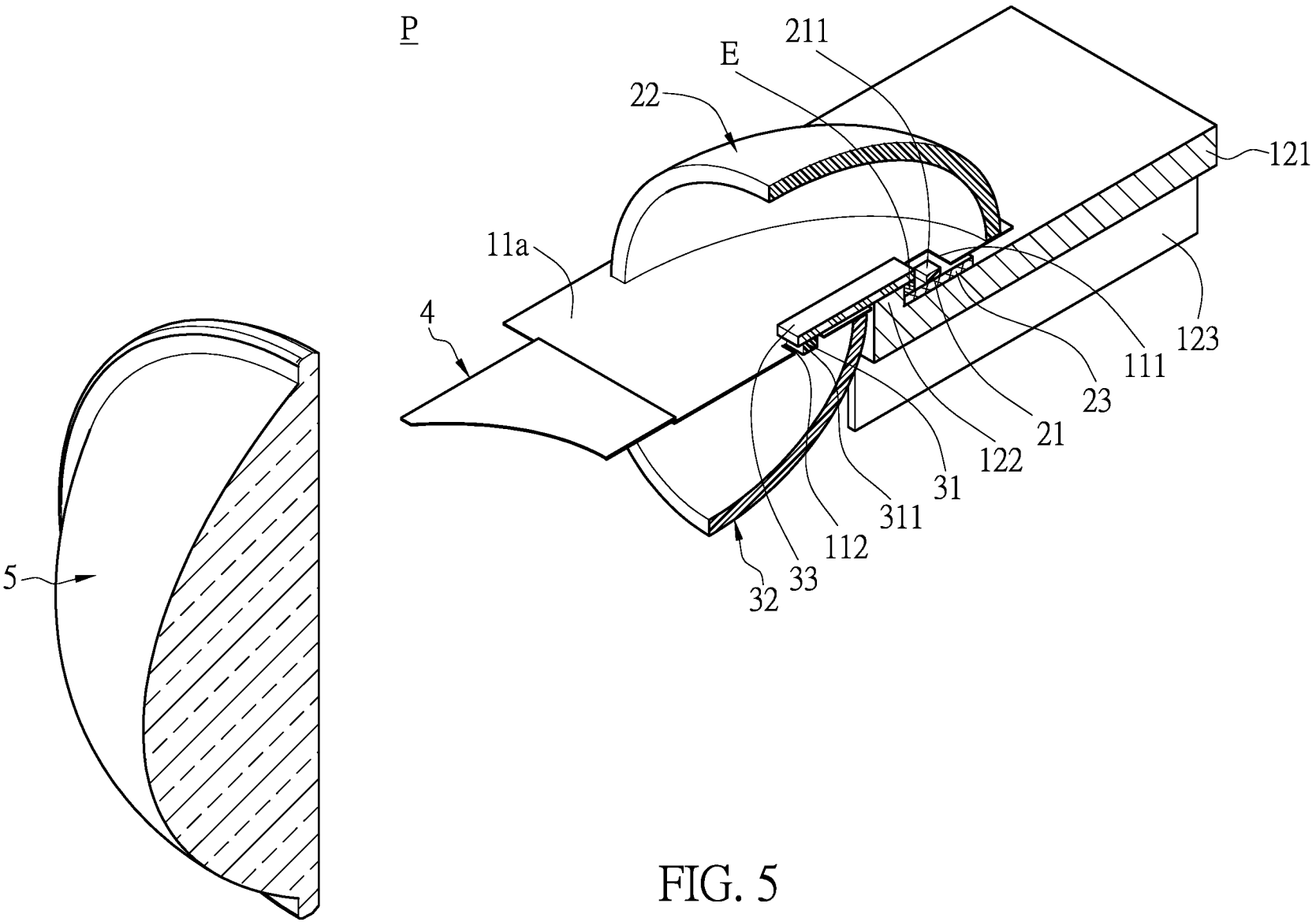
FIG. 5 is a perspective sectional view of the light projecting device according to the first embodiment of the present disclosure.
Figure 6:
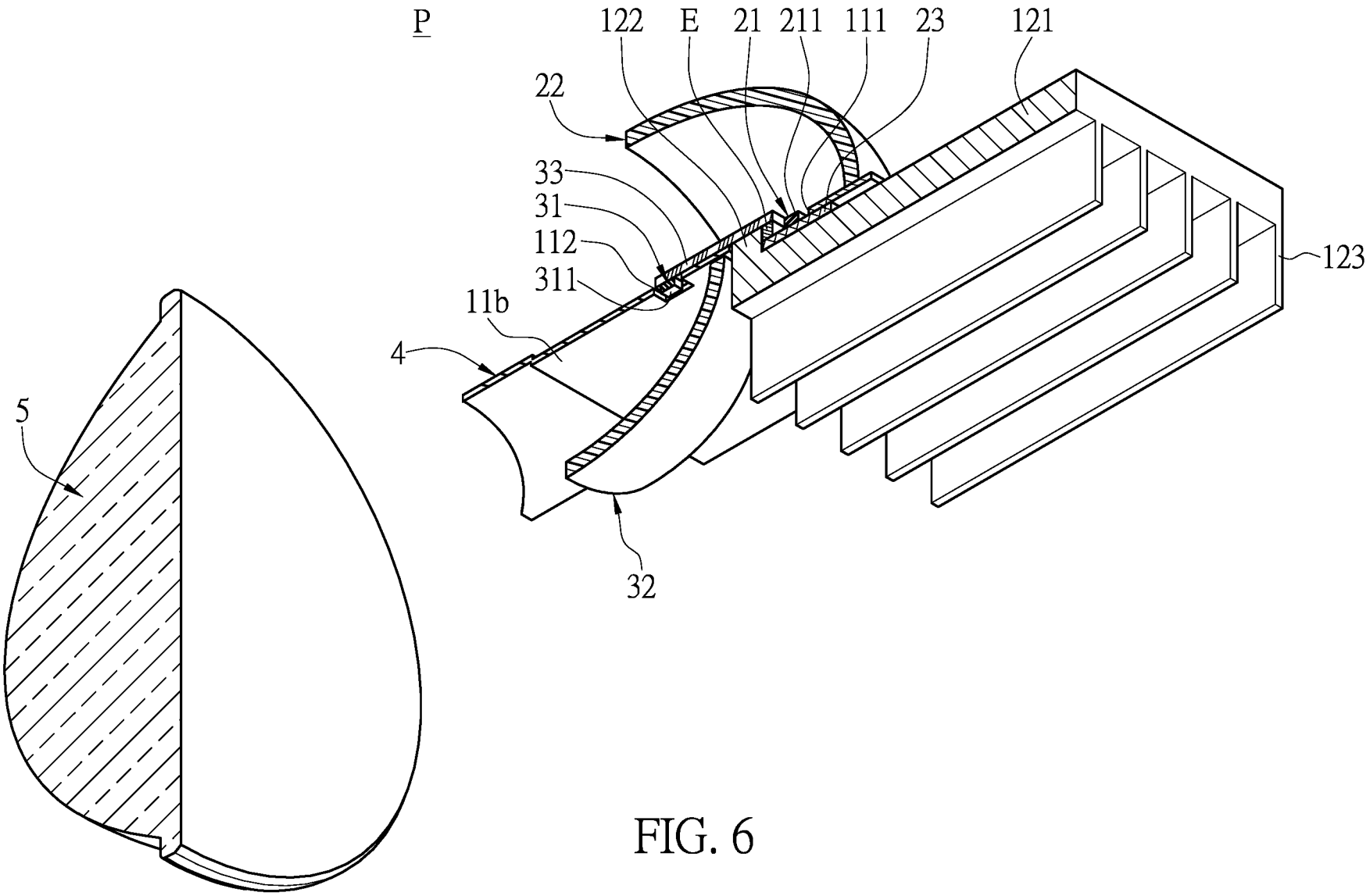
FIG. 6 is another perspective sectional view of the light projecting device according to the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 7, the first embodiment of the present disclosure provides a light projecting device P which includes a supporting unit 1, a first light source 2, a second light source 3, a light guiding unit 4 and a lens 5. The first light source 2 and the second light source 3 both are disposed on the supporting unit 1. The first light source 2 includes at least one first lighting unit 21 and a first reflecting unit 22 corresponding in position to the at least one first lighting unit 21. The second light source 3 includes at least one second lighting unit 31 and a second reflecting unit 32 corresponding in position to the at least one second lighting unit 31. The light guiding unit 4 is disposed in front of the supporting unit 1 and the lens 5 is disposed in front of the light guiding unit 4. It is worth mentioning that, the first lighting unit 21 has a first light emitting surface 211 and the second lighting unit 31 has a second light emitting surface 311, and the light emitting direction of the first light emitting surface 211 is opposite to that of the second light emitting surface 311 and the first light emitting surface 211 and the second light emitting surface 311 are coplanar with each other or in the vicinity of a plane. More specifically, the first light emitting surface 211 and the second light emitting surface 311 have a spacing therebetween that is between 0 mm and 5 mm, and preferably between 0 mm and 3.2 mm. Therefore, the light utilization efficiency of the light projecting device P can be increased while satisfying requirements for miniaturization.

In the present disclosure, the first light source 2, the light guiding unit 4 and the lens 5 work with each other to produce a low beam illumination pattern (also called lower illumination pattern). The second light source 3, the light guiding unit 4 and the lens 5 work with each other to produce a high beam illumination pattern (also called upper illumination pattern).

The light projecting device P can be applied to vehicle lights specified by the United Nations Economic Commission for Europe (ECE) R37 Regulation, available types of which are H4, HS1, S1, S2, S3, H1, H7 and H11, but the present disclosure is not limited thereto. That is to say, the light projecting device P can be used in place of a conventional high beam or low beam light source for vehicles such as a halogen lamp, tungsten halogen lamp or xenon lamp (i.e., HID lamp).

Referring to FIG. 3 to FIG. 7, the supporting unit 1 includes a partitioning board 11 and a heat dissipating assembly 12. The partitioning board 11 is configured to prevent lights of the first light source 2 from not projecting outwardly along light paths required for a low beam light distribution. Therefore, there is no stray light above or in the vicinity of a cut-off line of a resulting low beam illumination pattern. In addition, the partitioning board 11 can prevent lights of the first light source 2 and the second light source 3 from interfering with each other. The heat dissipating assembly 12 is configured to dissipate heat generated from the first light source 2 and the second light source 3. More specifically, the partitioning board 11 may be formed of an opaque plastic, but is not limited thereto. The partitioning board 11 has a first supporting surface 11*a* and a second supporting surface 11*b* located at the two opposite sides thereof. The first reflecting unit 22 is disposed on the first supporting surface 11*a*, and the first lighting unit 21 is disposed in the vicinity of the second supporting surface 11*b*. The second reflecting unit 31 is disposed on the second supporting surface 11*b*, and the second lighting unit 31 is disposed in the vicinity of the first supporting surface 11*a*. Furthermore, the projections of the first lighting unit 21 and the second lighting unit 31 do not overlap with each other in a vertical direction. In the present embodiment, the second lighting unit 31 may be located outside an area defined by a predetermined radius from the first lighting unit 21. The first lighting unit 21 and the second lighting unit 31 are staggered from each other in a length direction of the partitioning board 11. The partitioning board 11 has at least one first opening 111 and at least one second opening 112, such that lights generated from the first lighting unit 21 can project toward the first reflecting unit 22 and lights generated from the second lighting unit 31 can project toward the second reflecting unit 32. In practice, the first light emitting surface 211 of the first lighting unit 21 can be exposed from the first supporting surface 11*a* through the first opening 111, and the second light emitting surface 311 of the second lighting unit 31 can be exposed from the second supporting surface 11*b* through the second opening 112.

Although FIG. 1 to FIG. 7 show that, in the light projecting device P, the second light source 3 is closer to the light guiding unit 4 than the first light source 2, according to different requirements, the first light source 2 can be closer to the light guiding unit 4 than the second light source 3. In addition, although the first lighting unit 21 and the second lighting unit 31 respectively emit lights through the first opening 111 and the second opening 112, according to actual requirements, the first lighting unit 21 and the second lighting unit 31 may not be covered or blocked by the partitioning board 11. For example, the partitioning board 11 may only have the second opening 112 and the first lighting unit 21 is located outside the cover area of the partitioning board 11. Under such structure, lights of the first lighting unit 21 can directly project to the first reflecting unit 22 without passing through the partitioning board 11.

Referring to FIG. 3 to FIG. 7, in the present disclosure, the first reflecting unit 22 is configured to reflect lights generated from the first lighting unit 21. The first reflecting unit 22 is a light reflecting cup and has a reflecting surface with only one curvature or a number of curvatures. The reflecting surface is, for example, a partial ellipsoidal surface or a composite ellipsoidal surface, but is not limited thereto. The first reflecting unit 22 has a first focal point 22*a* and a second focal point 22*b* corresponding in position to the first focal point 22*a*. The first focal point 22*a* is located in a cover area of the first reflecting unit 22, and the second focal point 22*b* is located outside the cover area of the first reflecting unit 22 or in an area between the first reflecting unit 22 and the lens 5. More specifically, the lens 5 has a lens optical axis 51 and a lens focal point 52 located on the lens optical axis 51. The second focal point 22*b* can be located on the lens optical axis 51 and coincide with the lens focal point 52, or the second focal point 22*b* can be deviated from the lens optical axis 51 and located in the vicinity of the lens focal point 52.

The first lighting unit 21 is disposed on a first circuit board 23 that has a drive control circuit of the first lighting unit 21. The first lighting unit 21 may be an LED or a package structure including a number of LEDs. The first lighting unit 21 can be disposed on or in the vicinity of the first focal point 22*a*. Preferably, the lens optical axis 51 passes through an area in the vicinity of the first light emitting surface 211 of the first lighting unit 21. When the first lighting unit 21 is lighted, the light projecting device P produces a low beam illumination pattern.

Similarly, the second reflecting unit 32 is configured to reflect lights generated from the second lighting unit 31. The second reflecting unit 32 is also a light reflecting cup and has a reflecting surface with only one curvature or a number of curvatures. The reflecting surface is, for example, a partial ellipsoidal surface or a composite ellipsoidal surface, but is not limited thereto. The second reflecting unit 32 may have a smaller size than the first reflecting unit 22, i.e., the area of the reflecting surface of the second reflecting unit 32 is smaller than that of the first reflecting unit 22, but is not limited thereto. The second reflecting unit 32 has a first focal point 32*a* and a second focal point 32*b* corresponding in position to the first focal point 32*a*. The first focal point 32*a* is located in a cover area of the second reflecting unit 32, and the second focal point 32*b* is located outside the cover area of the second reflecting unit 32 or in an area between the second reflecting unit 32 and the lens 5. More specifically, the second focal point 32*b* can be located on the lens optical axis 51 and coincide with the lens focal point 52, or the second focal point 32*b* can be deviated from the lens optical axis 51 and located in the vicinity of the lens focal point 52.

The second lighting unit 31 is disposed on a second circuit board 33 that has a drive control circuit of the second lighting unit 31. The first circuit board 23 and the second circuit board 33 are in electrical connection by an electrically connecting structure such as an electrical connector. The second lighting unit 31 may be an LED or a package structure including a number of LEDs. The second lighting unit 31 can be disposed on or in the vicinity of the first focal point 32*a*. Preferably, the lens optical axis 51 passes through an area in the vicinity of the second light emitting surface 311 of the second lighting unit 31. When the second lighting unit 31 is lighted, the light projecting device P produces a high beam illumination pattern.

It should be noted that, although the light projecting device P produces a low beam illumination pattern when the first lighting unit 21 is lighted and produces a high beam illumination pattern when the second lighting unit 31 is lighted, the present disclosure is not limited thereto. In other embodiments, the light projecting device P can produce a low beam or high beam illumination pattern when the first lighting unit 21 and the second lighting unit 31 both are lighted.

Referring to FIG. 3 to FIG. 7, the first lighting unit 21 and the second lighting unit 31 would generate a large amount of heat when they are lighted. In order to dissipate heat more efficiently, the first lighting unit 21 and the second lighting unit 31 are directly connected to the heat dissipating assembly 12. Accordingly, the service life and the stability of the first lighting unit 21 and the second lighting unit 31 can be increased. More specifically, the heat dissipating assembly 12 includes a heat conducting board 121, a heat conducting column 122 and a plurality of heat dissipating funs 123, which may be made of high thermal conductivity materials including aluminum, copper or their alloys and non-metal materials such as silicon, graphite and aluminum nitride. The heat conducting board 121 includes a first heat transmitting surface 121*a* and a second heat transmitting surface 121*b* opposite to the first heat transmitting surface 121*a*. The heat conducting column 122 is disposed on the first heat transmitting surface 121*a* and extends through the first opening 111 of the partitioning board 11. The heat dissipating fins 123 are disposed on the second heat transmitting surface 121*b* at intervals. The heat conducting column 122 and the heat dissipating fins 123 extend in a direction that is substantially perpendicular to a length direction of the heat conducting board 121. The first circuit board 23 is disposed on the first heat transmitting surface 121*a* of the heat conducting board 121, and an front thereof may or may not contact the heat conducting column 122. The second circuit board 33 is disposed in the vicinity of the first supporting surface 11*a* of the partitioning board 11 and connected to the heat conducting column 122. Therefore, heat generated from the first lighting unit 21 and the second lighting unit 31 can be uniformly transmitted to the heat dissipating fins 123 by the heat conducting board 121 to be quickly dissipated.

Referring to FIG. 3 to FIG. 8, the light guiding unit 4 is configured to guide lights projected from the first light source 2 or the second light source 3 to the lens 5. The lights passing through the light guiding unit 4 are then redistributed by the lens 5 to produce a low beam or high beam illumination pattern. The light guiding unit 4 can be integrated with the partitioning board 11 and extends toward the lens 5 from a front end of the partitioning board 11. The lens can be connected to the supporting unit 1 by a lens holder (not shown), but is not limited thereto. In other embodiments, the light guiding unit 4 can be separated from the partitioning board 11 and immovably fixed on the lens holder.

More specifically, the light guiding unit 4 is an opaque light guiding plate that extends along the length direction of the partitioning board 11. The light guiding unit 4 has a top surface 41 located at the same side of the first supporting surface 11*a* of the partitioning board 11 for forming a horizontal light cut-off line required for low beam lights. That is to say, low beam illumination patterns produced by the light projecting device P have a clear light cut-off line. The top surface 41 includes a first flat surface 411, an oblique surface 412 and a second flat surface 413. The first flat surface 411 is located higher than the second flat surface 413, and the oblique surface 412 is connected between the first flat surface 411 and the second flat surface 413. It should be noted that, the top surface 41 of the light guiding unit 4 can be a flat surface, such that low beam illumination patterns produced by the light projecting device P all are symmetrical illumination patterns.

Figure 7:
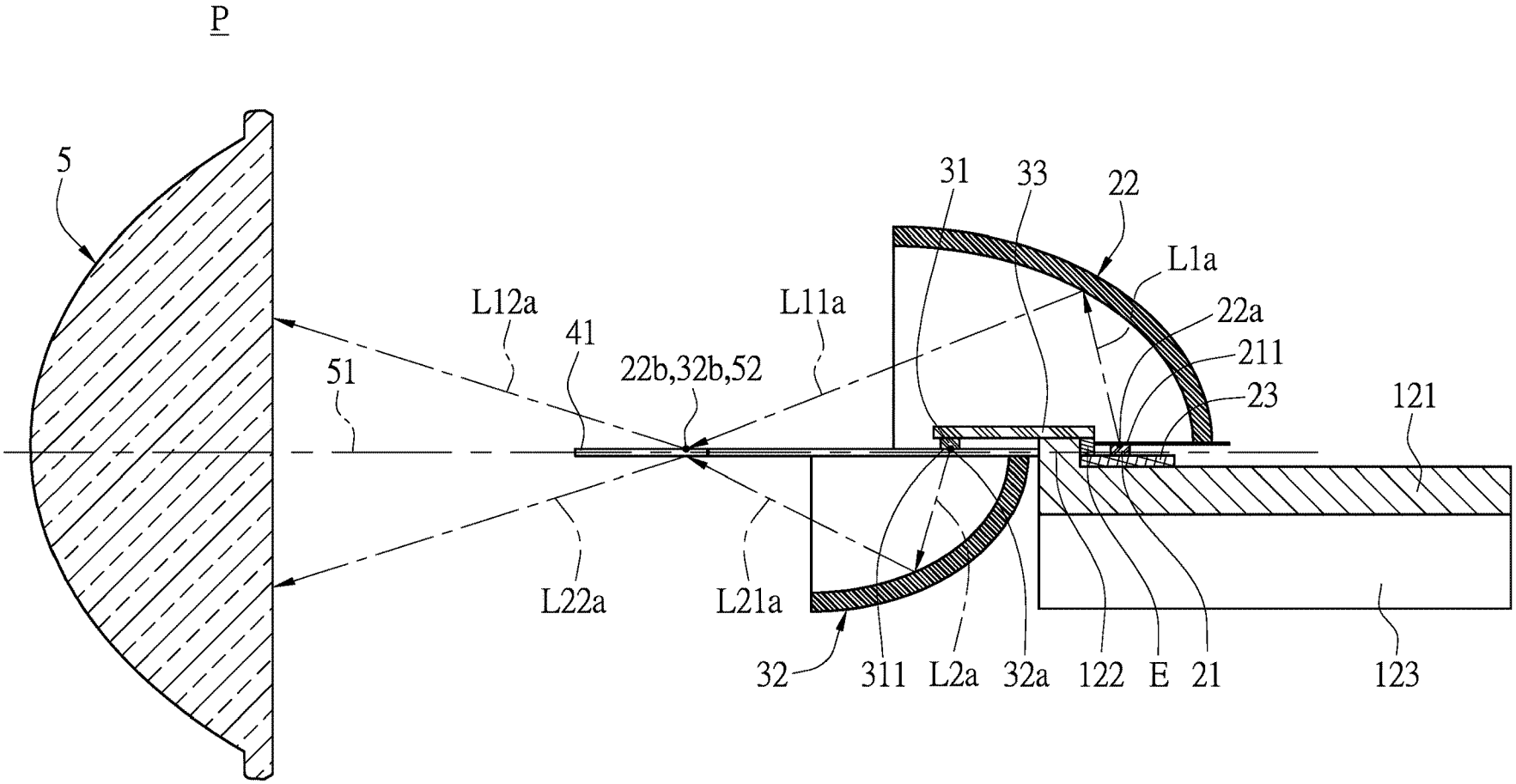
FIG. 7 is a schematic view showing light paths of the light projecting device according to the first embodiment of the present disclosure.
Figure 8:
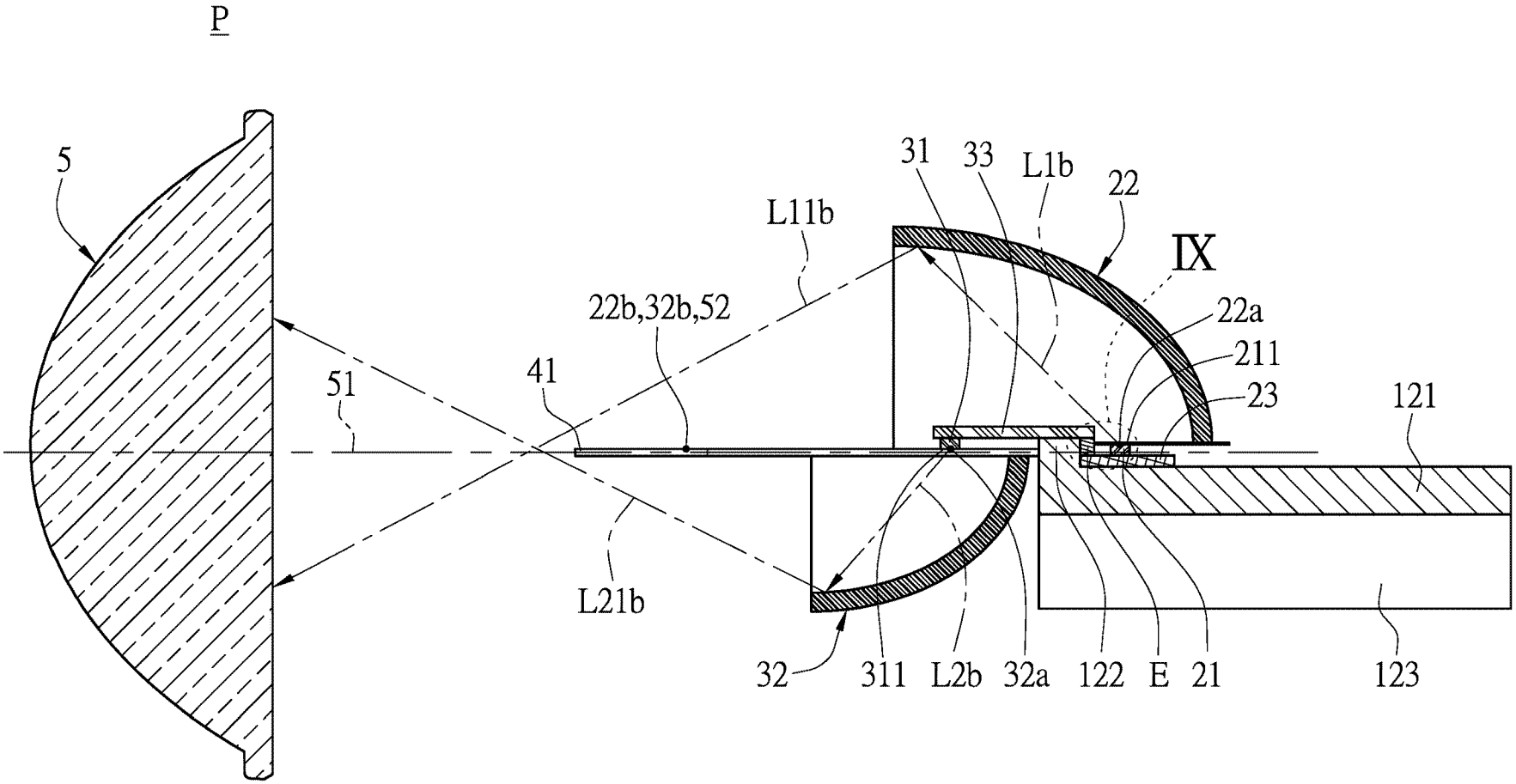
FIG. 8 is another schematic view showing different light paths of the light projecting device according to the first embodiment of the present disclosure.

Referring to FIG. 7 and FIG. 8, in the present disclosure, the second focal point 22*b* of the first reflecting unit 22, the second focal point 32*b* of the second reflecting unit 32 and the lens focal point 52 are substantially coincide with each other and all located on the top surface 41 of the light guiding unit 4, but the present disclosure is not limited thereto. In other embodiments, the second focal point 22*b* of the first reflecting unit 22 and the second focal point 32*b* of the second reflecting unit 32 may be in the vicinity of the lens focal point 52. When a light L1*a* of the first lighting unit 21 is emitted to the first reflecting unit 22, a primary reflection light L11*a* can be produced to project to the light guiding unit 4. The primary reflection light L11*a* is then reflected by the light guiding unit 4 to produce a secondary reflection light L12*a* that projects to the lens 5 through an area above the lens optical axis 52. The secondary reflection light L12*a* is then projected outwardly through the lens 5 to become a portion of a low beam illumination pattern. In addition, when a light L1*b* of the first lighting unit 21 is emitted to the first reflecting unit 22, a primary reflection light L11*b* can be produced to directly pass through a gap between the light guiding unit 4 and the lens 5 so as to project to the lens 5 through an area below the lens optical axis 52. The primary reflection light L11*b* is then projected outwardly through the lens 5 to become another portion of the low beam illumination pattern. Such two portions constitute the complete low beam illumination pattern.

When a light L2*a* of the second lighting unit 31 is emitted to the second reflecting unit 32, a primary reflection light L21*a* can be produced to project to the light guiding unit 4. The primary reflection light L21*a* is then reflected by the light guiding unit 4 to produce a secondary reflection light L22*a* that projects to the lens 5 through an area below the lens optical axis 51. The secondary reflection light L22*a* is then projected outwardly through the lens 5 to become a portion of a high beam illumination pattern. In addition, when a light L2*b* of the second lighting unit 31 is emitted to the second reflecting unit 32, a primary reflection light L21*b* can be produced to directly pass through the gap between the light guiding unit 4 and the lens 5 so as to project to the lens 5 through an area above the lens optical axis 52. The primary reflection light L21*b* is then projected outwardly through the lens 5 to become another portion of the high beam illumination pattern. Such two portions constitute the complete high beam illumination pattern.

Figure 9:
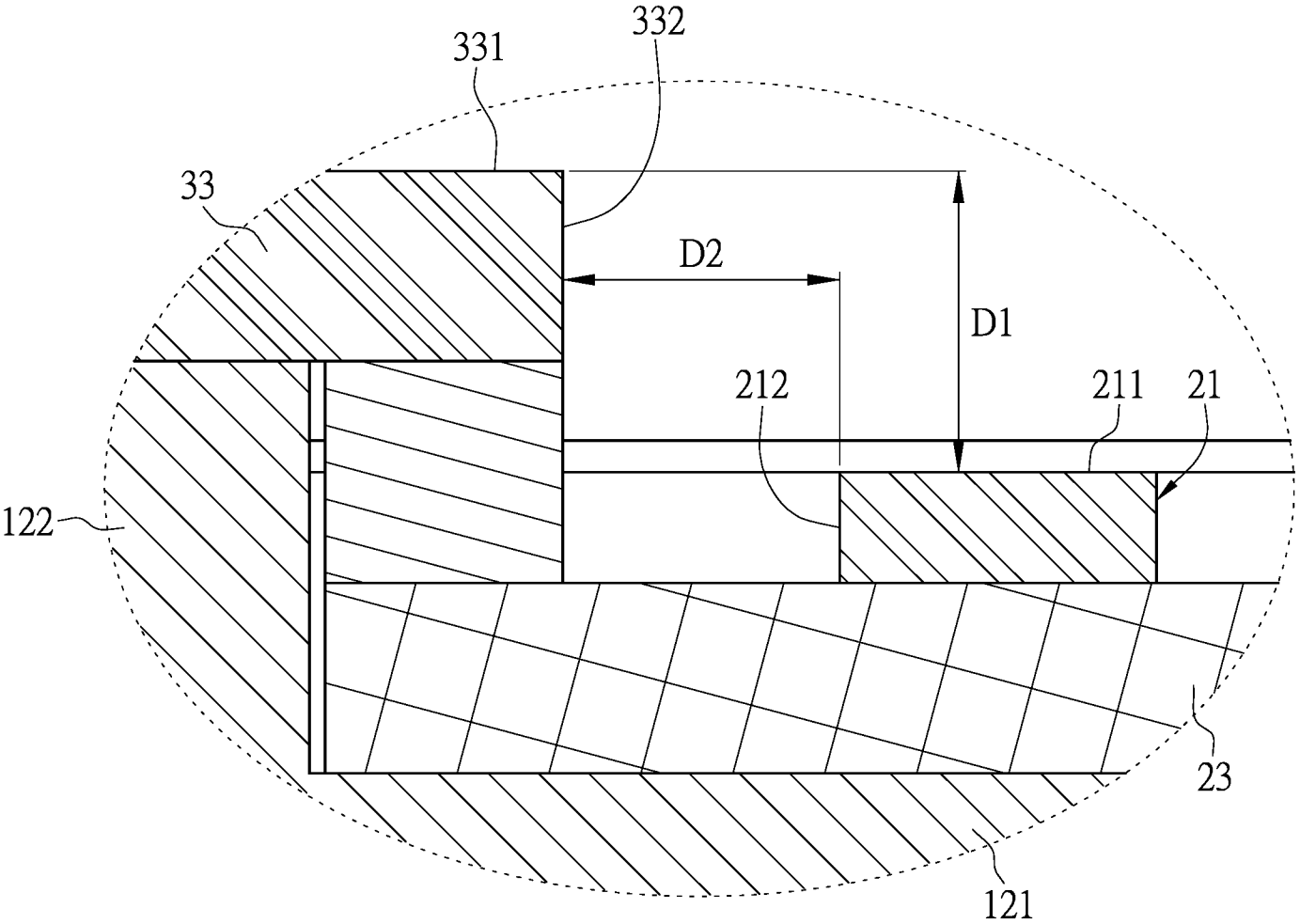
FIG. 9 is an enlarged view of section IX of FIG. 8.
Figure 10:
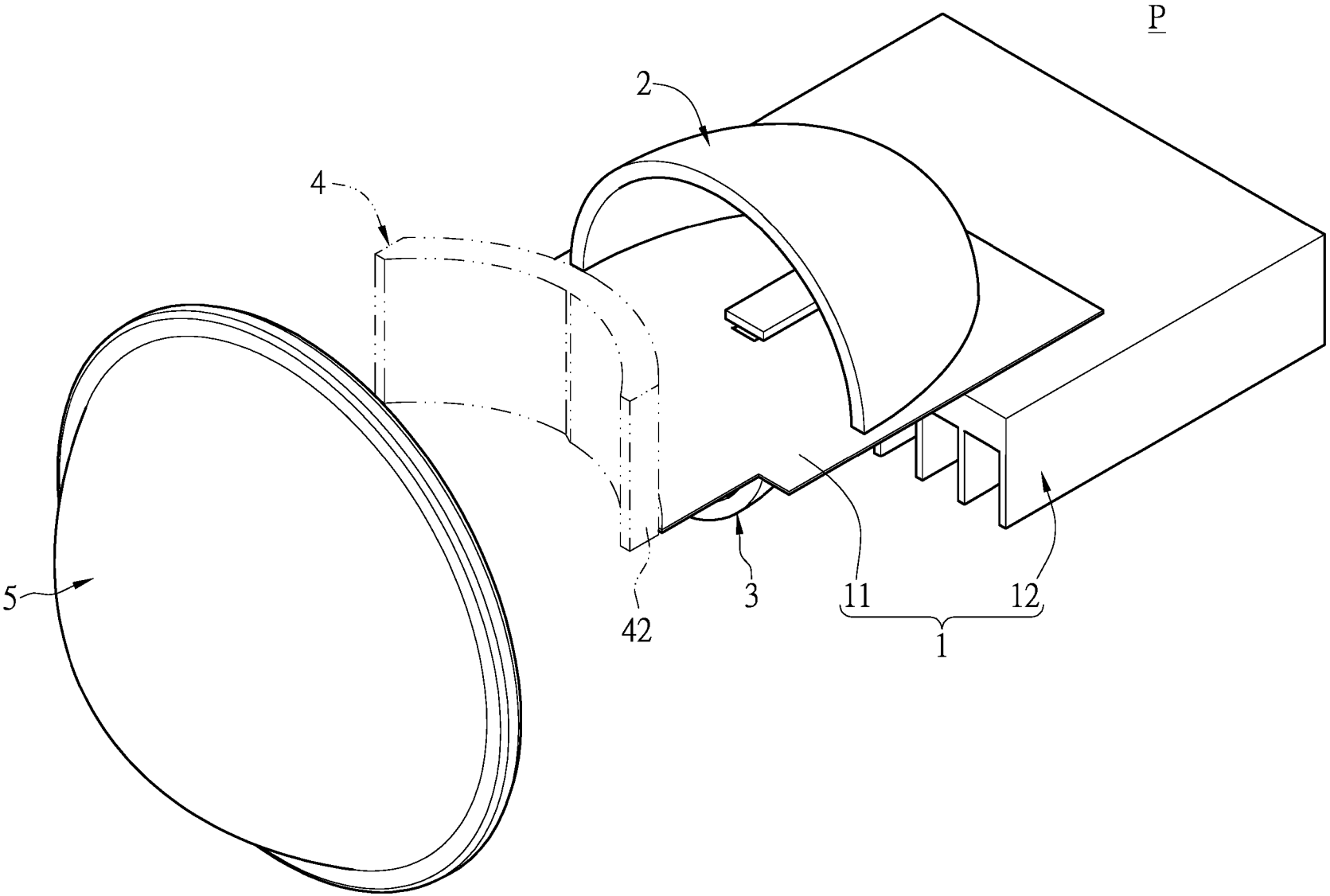
FIG. 10 is an assembled perspective view of a light projecting device having high light utilization efficiency according to a second embodiment of the present disclosure.
Figure 11:
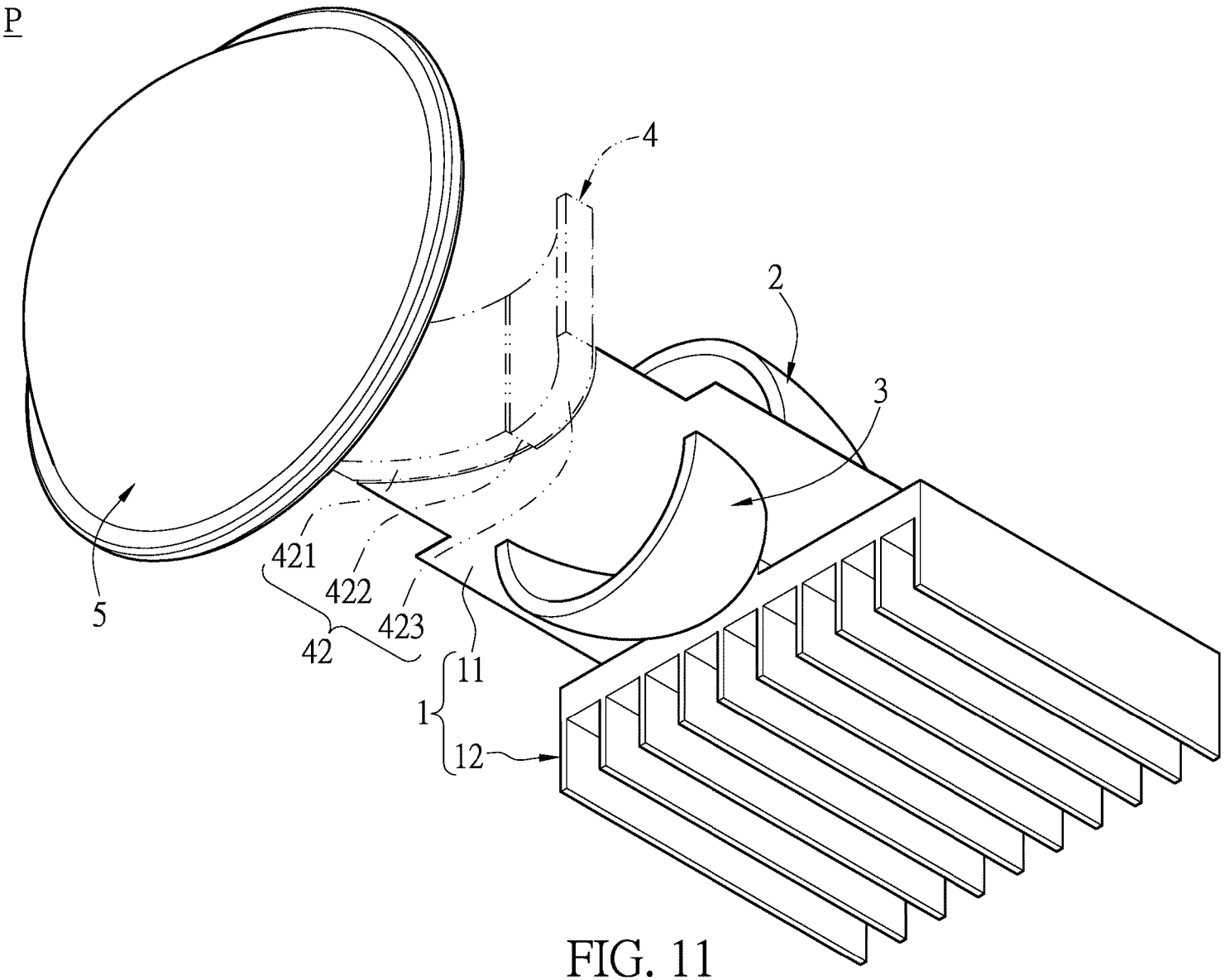
FIG. 11 is another assembled perspective view of the light projecting device according to the second embodiment of the present disclosure.

Referring to FIG. 9, the second circuit board 33 has a surface 331 that is distant from the first supporting surface 11*a* and has a first vertical distance D1 relative to the first light emitting surface 211. The first vertical distance D1 is preferably less than 15 mm. The second circuit board 33 has a lateral surface 332 distant from the lens 5. The first lighting unit 21 has a lateral surface 212 facing the lens 5. The lateral surface 332 of the second circuit board 33 and the lateral surface 212 of the first lighting unit 21 has a second vertical distance D2 therebetween. The second vertical surface D2 is preferably less than 15 mm.

Second Embodiment

Referring to FIG. 10 to FIG. 15, the second embodiment of the present disclosure provides a light projecting device P which includes a supporting unit 1, a first light source 2, a second light source 3, a light guiding unit 4 and a lens 5. The first light source 2 and the second light source 3 both are disposed on the supporting unit 1. The first light source 2 includes at least one first lighting unit 21 and a first reflecting unit 22 corresponding in position to the at least one first lighting unit 21. The second light source 3 includes at least one second lighting unit 31 and a second reflecting unit 32 corresponding in position to the at least one second lighting unit 31. The light guiding unit 4 is disposed in front of the supporting unit 1 and the lens 5 is disposed in front of the light guiding unit 4. It is worth mentioning that, the first lighting unit 21 has a first light emitting surface 211 and the second lighting unit 31 has a second light emitting surface 311, and the light emitting direction of the first light emitting surface 211 is opposite to that of the second light emitting surface 311 and the first light emitting surface 211 and the second light emitting surface 311 are coplanar with each other or in the vicinity of a plane. More specifically, the first light emitting surface 211 and the second light emitting surface 311 have a spacing therebetween that is between 0 mm and 5 mm, and preferably between 0 mm and 3.2 mm. Therefore, the light utilization efficiency of the light projecting device P can be increased while satisfying requirements for miniaturization.

The main difference between the present embodiment and the first embodiment is that the light guiding unit is a transparent light guiding block that extends along a thickness direction of the partitioning board 11. The technical details of the supporting unit 1, the first light source 2, the second light source 3 and the lens 5 are described in the first embodiment, and will not be reiterated herein. It should be noted that, the light guiding unit 4 and a notch of the partitioning board 11 complement each other in shape. The width of the light guiding unit 4 is approximately equal to that of the notch of the partitioning board 11, and there is no particular limitation to the extension length of the light guiding unit 4. The light guiding unit 4 has a bottom surface located at the same side of the second supporting surface 11*b* of the partitioning board 11 for forming a horizontal light cut-off line required for low beam lights. That is to say, low beam illumination patterns produced by the light projecting device P have a clear light cut-off line. The bottom surface 42 includes a first flat surface 421, an oblique surface 422 and a second flat surface 423. The first flat surface 421 is located higher than the second flat surface 423, and the oblique surface 422 is connected between the first flat surface 421 and the second flat surface 423. It should be noted that, the bottom surface 42 of the light guiding unit 4 can be a flat surface, such that low beam illumination patterns produced by the light projecting device P all are symmetrical illumination patterns.

Figure 12:
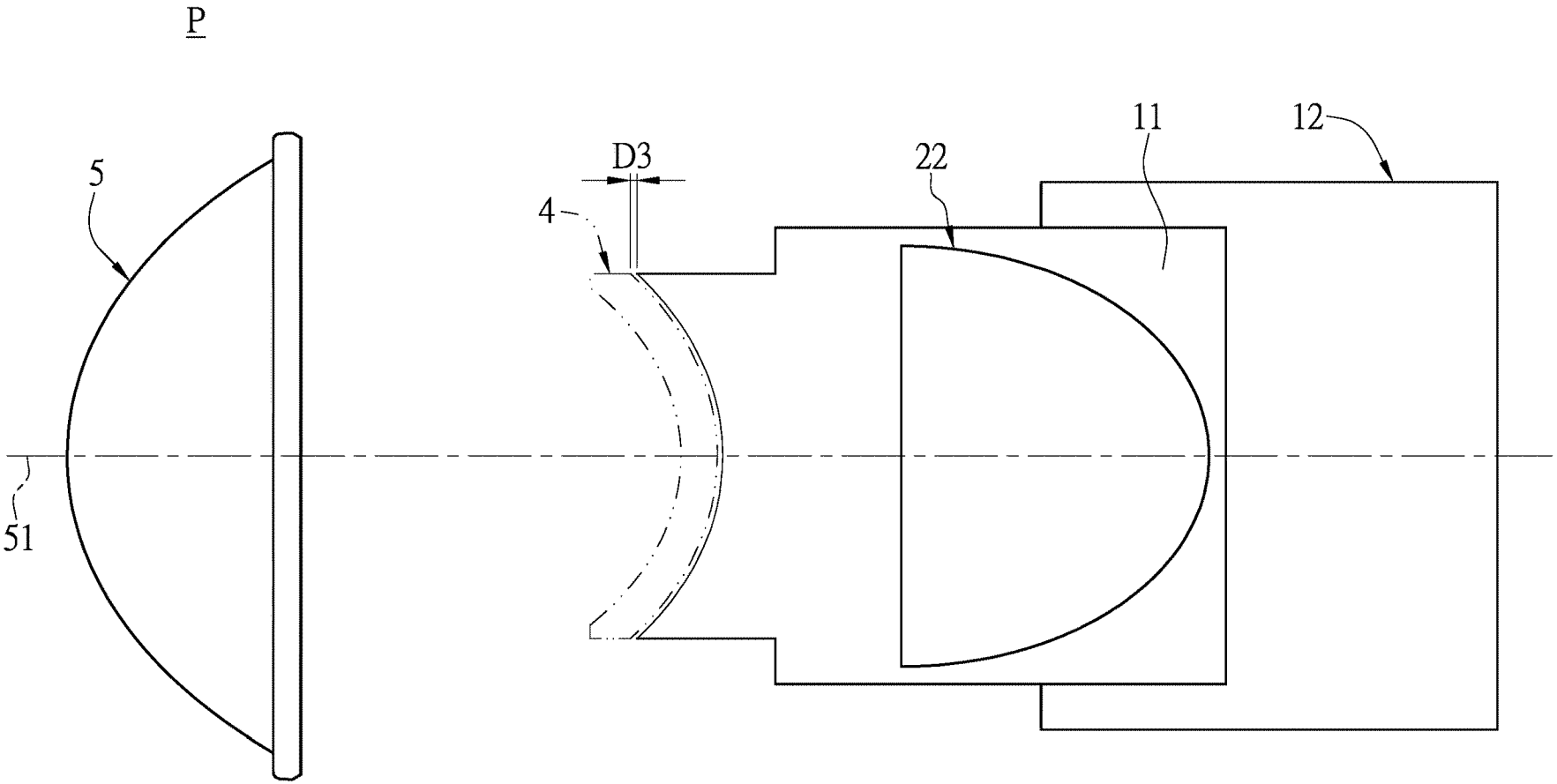
FIG. 12 is a top view of the light projecting device according to the second embodiment of the present disclosure.
Figure 13:
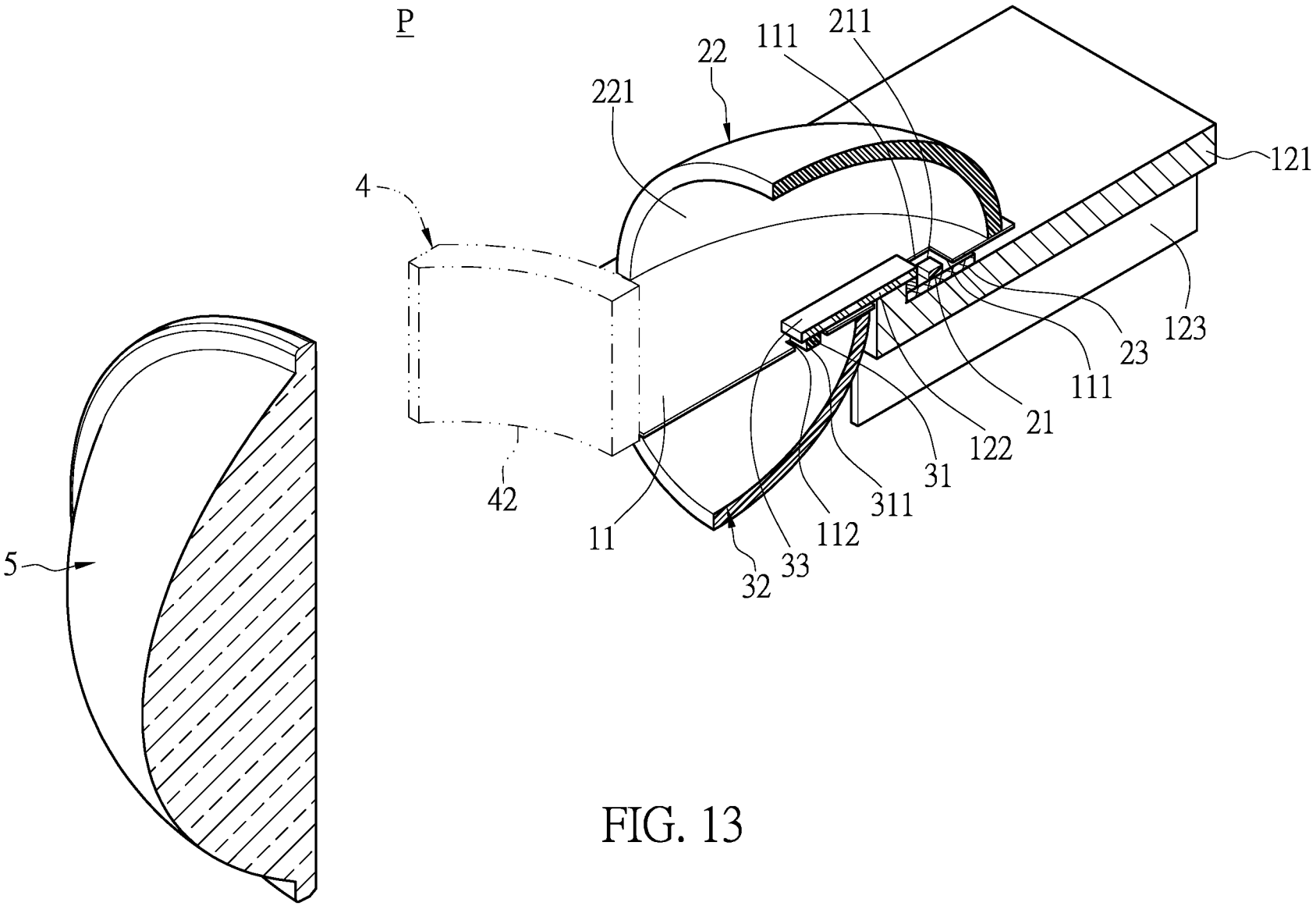
FIG. 13 is a perspective sectional view of an implementation example of the light projecting device according to the second embodiment of the present disclosure.

In the present disclosure, the light guiding unit 4 may be formed of glass, silicone or polycarbonate (PC), but is not limited thereto. As shown in FIG. 12, the light guiding unit 4 and the partitioning board 11 have a predetermined distance D3 therebetween that is between 0.01 mm and 1 mm. Therefore, lights of the first light source 2 can be prevented from projecting outwardly from an area between the light guiding unit 4 and the partitioning board 11. It should be noted that, once the lights of the first light source 2 project outwardly from an area between the light guiding unit 4 and the partitioning board 11, stray lights would be produced above a cut-off line of a low beam illumination pattern.

Figure 14:
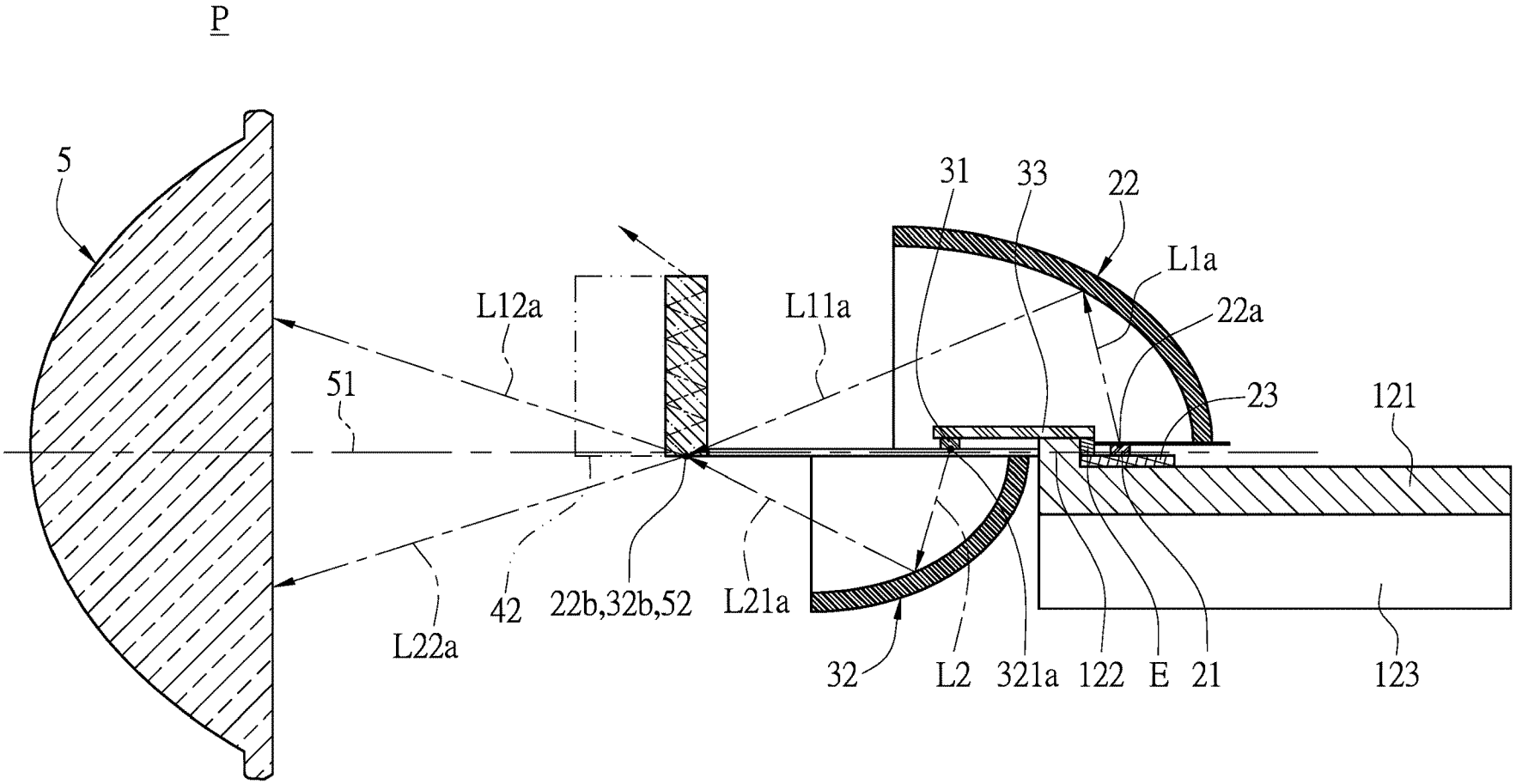
FIG. 14 is a schematic view showing light paths of the implementation example of the light projecting device according to the second embodiment of the present disclosure.
Figure 15:
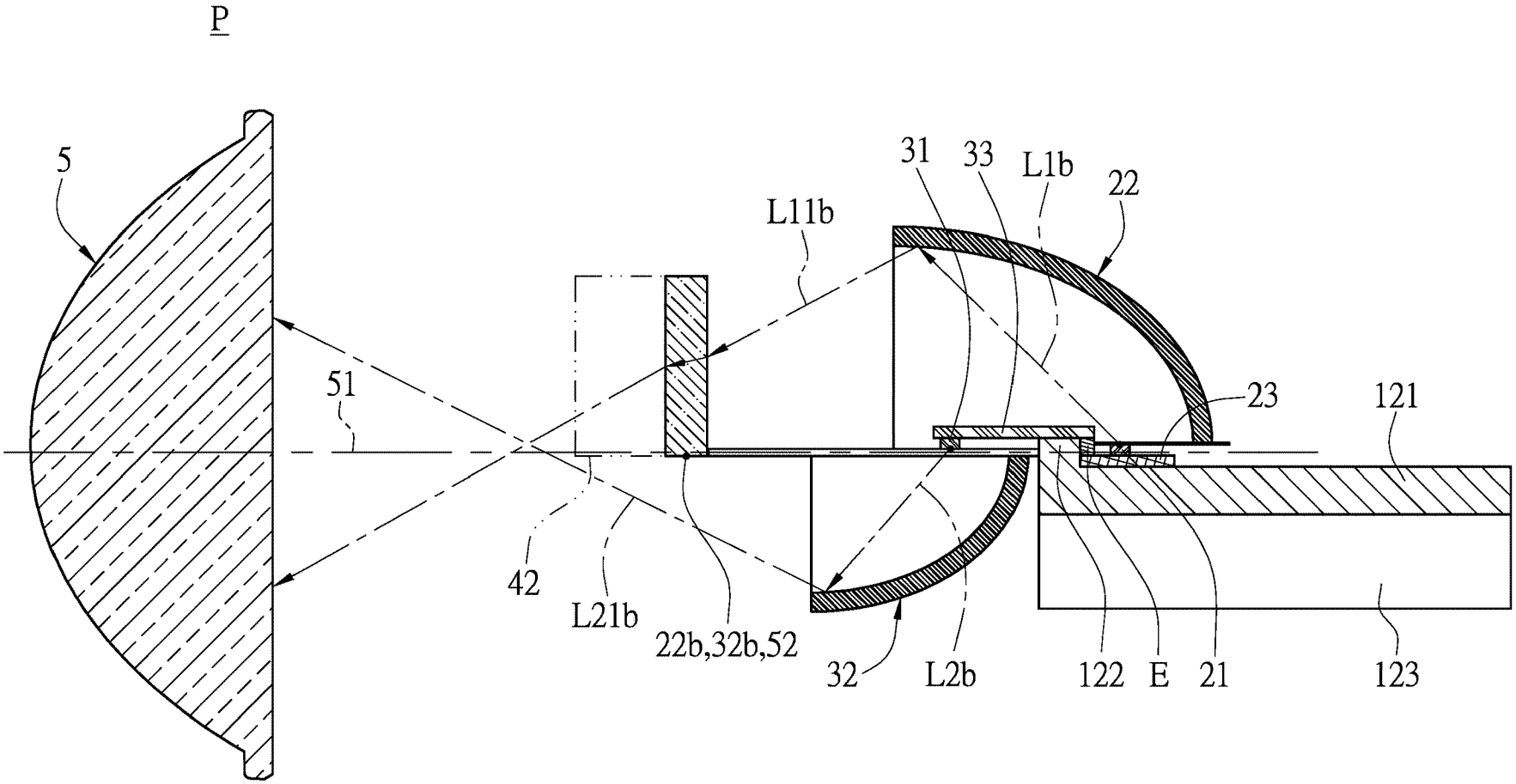
FIG. 15 is another schematic view showing different light paths of the implementation example of the light projecting device according to the second embodiment of the present disclosure.
Figure 16:
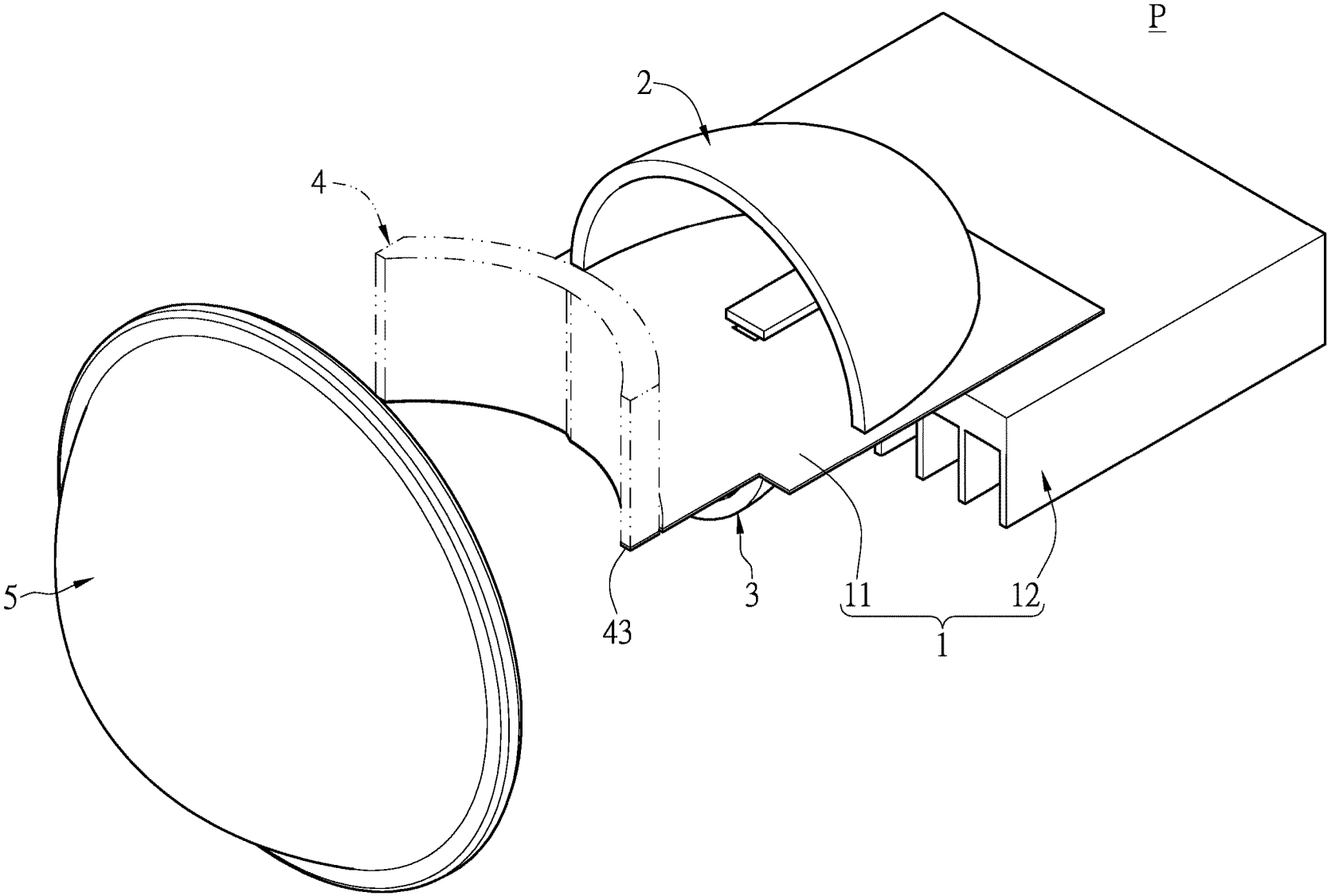
FIG. 16 is an assembled perspective view of another implementation example of the light projecting device according to the second embodiment of the present disclosure.
Figure 17:
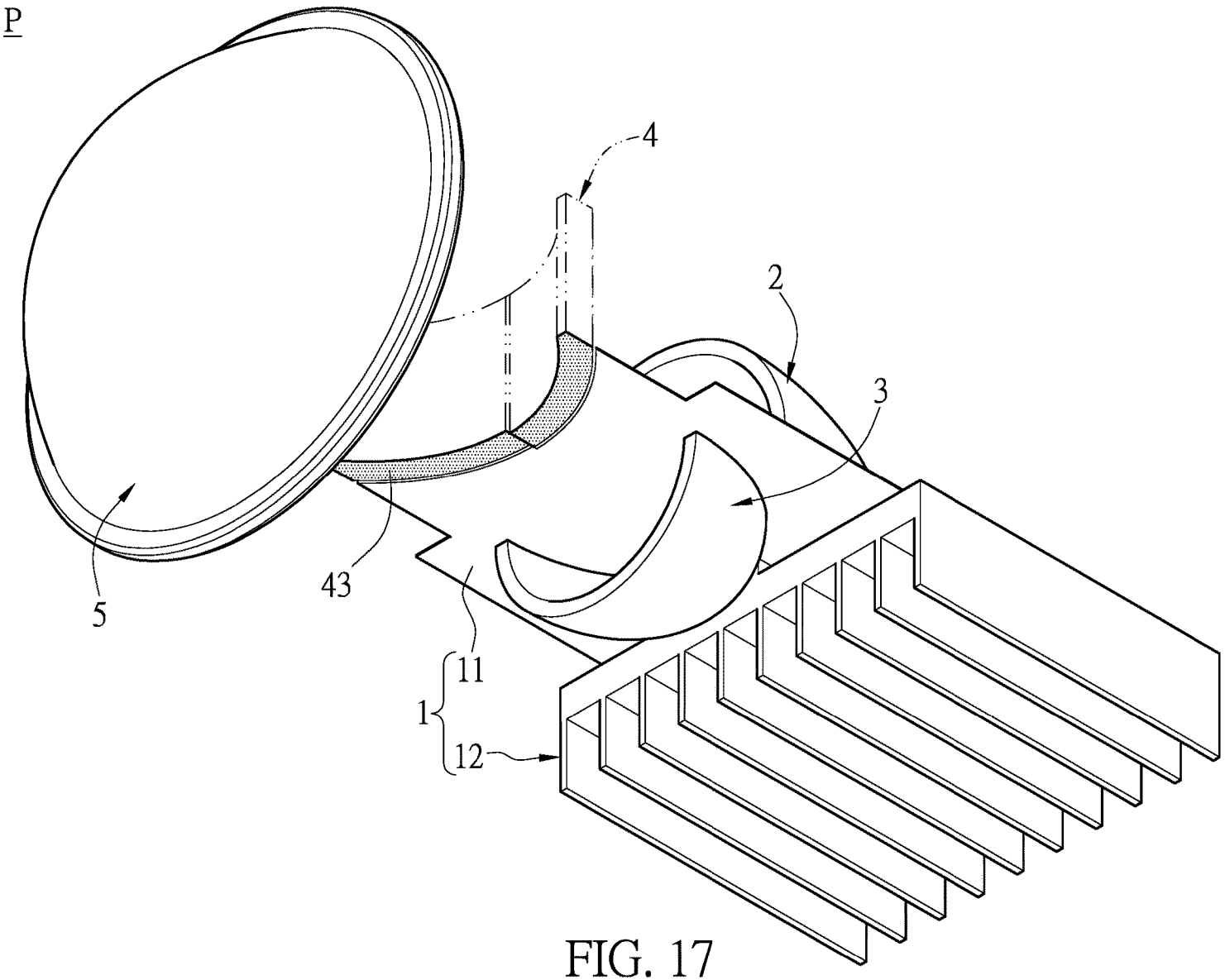
FIG. 17 is another assembled perspective view of the another implementation example of the light projecting device according to the second embodiment of the present disclosure.
Figure 18:
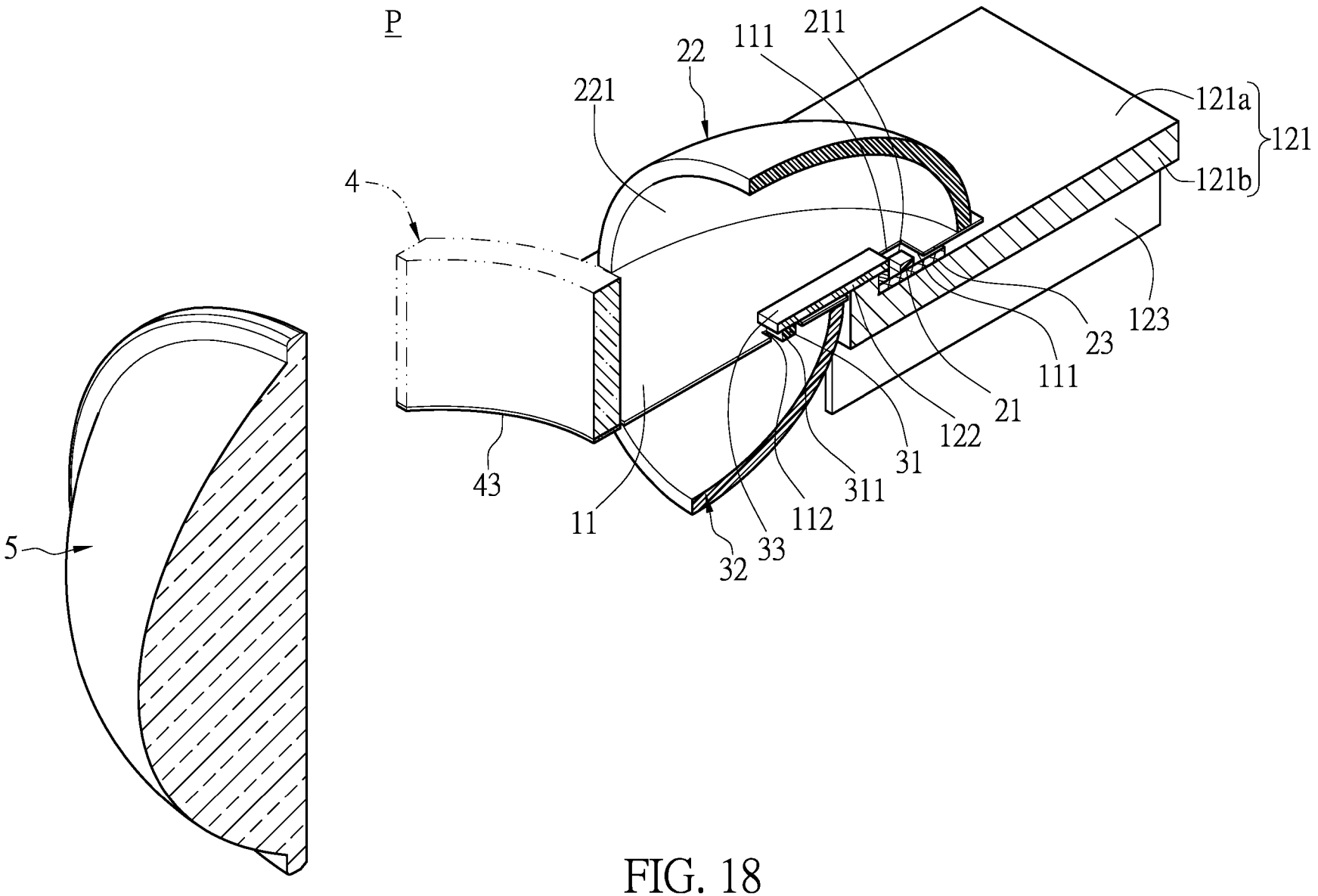
FIG. 18 is a perspective sectional view of the another implementation example of the light projecting device according to the second embodiment of the present disclosure.
Figure 19:
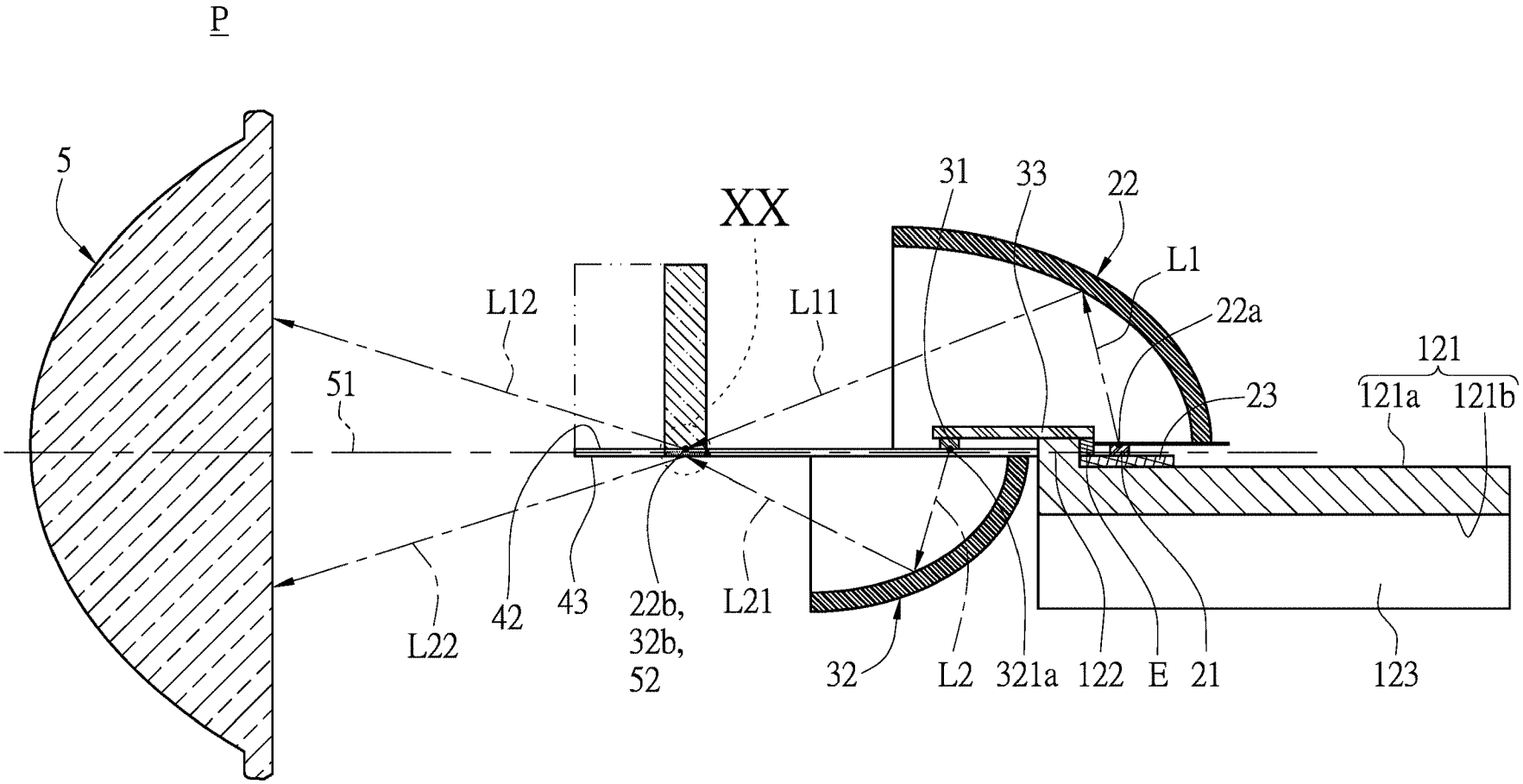
FIG. 19 is a schematic view showing light paths of the another implementation example of the light projecting device according to the second embodiment of the present disclosure.
Figure 20:
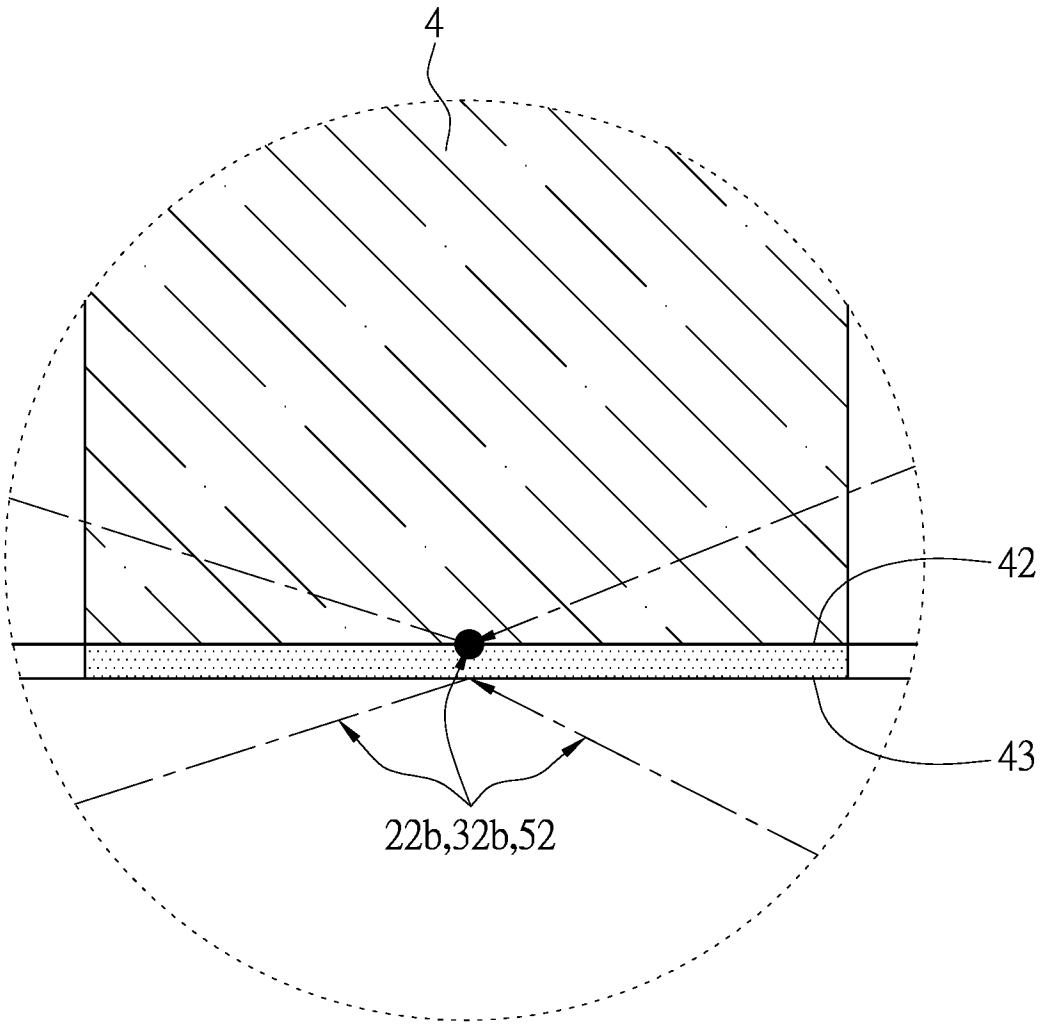
FIG. 20 is an enlarged view of section XVIII of FIG. 19.

As shown in FIG. 14 and FIG. 15, when a light L1*a* of the first lighting unit 21 is emitted to the first reflecting unit 22, a primary reflection light L11*a* can be produced to project to the bottom surface 42. The primary reflection light L11*a* is then reflected by the bottom surface 42 to produce a secondary reflection light L12*a* that projects to the lens 5 through an area above the lens optical axis 51. The secondary reflection light L12*a* is then projected outwardly through the lens 5 to become a portion of a low beam illumination pattern. In addition, when a light L1*b* of the first lighting unit 21 is emitted to the first reflecting unit 22, a primary reflection light L11*b* can be produced to directly pass through a gap between the light guiding unit 4 and the lens 5 so as to project to the lens 5 through an area below the lens optical axis 51. The primary reflection light L11*b* is then projected outwardly through the lens 5 to become another portion of the low beam illumination pattern. Such two portions constitute the complete low beam illumination pattern. It should be noted that, the distance between the light guiding unit 4 is at a near distance from the partitioning board 11, such that the primary reflection light L11*b* cannot be outputted through an area between the light guiding unit 4 and the partitioning board 11.

When a light L2*a* of the second lighting unit 31 is emitted to the second reflecting unit 32, a primary reflection light L21*a* can be produced to project to the bottom surface 42. Then, only one portion of the primary reflection light L21*a* can be reflected by the bottom surface 42 to produce a secondary reflection light L 22*a* that projects to the lens 5 through an area below the lens optical axis 51. Another portion of the primary reflection light L21*a* enters the light guiding unit 4 (i.e., transparent light guiding block), and this causes a Fresnel loss. The secondary reflection light L 22*a* is then projected outwardly through the lower half of the lens 5 to become a portion of a high beam illumination pattern. In addition, when a light L2*b* of the second lighting unit 31 is emitted to the second reflecting unit 32, a primary reflection light L21*b* can be produced to directly pass through a gap between the light guiding unit 4 and the lens 5 so as to project to the lens 5 through an area above the lens optical axis 51. The primary reflection light L21*b* is then projected outwardly through the lens 5 to become another portion of the high beam illumination pattern. Such two portions constitute the complete high beam illumination pattern. It should be noted that, based on the structure in which the bottom surface 42 of the light guiding unit 4 has no high reflectivity material coated thereon, if the bottom surface 42 and the second light emitting surface 311 of the second lighting unit 31 are coplanar with each other or substantially on the same plane, the Fresnel loss caused by the primary reflection light L21*a* of the second light source 3 projecting to the bottom surface 42 can be minimized.

Preferably, as shown in FIG. 16 to FIG. 20, the bottom surface 42 of the light guiding unit 4 can have a light reflecting layer 43 formed thereon. The light reflecting layer 43 may be formed of a high reflectivity material such as aluminum and copper. Accordingly, when a light L2*a* of the second lighting unit 31 is emitted to the second reflecting unit 32, a primary reflection light L21*a* can be produced to project to the light reflecting layer 43. The primary reflection light L21*a* is then totally reflected by the light reflecting layer 43 to produce a secondary reflection light L22*a* that projects to the lower half of the lens 5. In addition, when a light L1*a* of the first lighting unit 21 is emitted to the first reflecting unit 22, a primary reflection light L11*a* can be produced to project to the light reflecting layer 43. The primary reflection light L11*a* is then totally reflected by the light reflecting layer 43 to produce a secondary reflection light L22*a* that projects to the upper half of the lens 5. It should be noted that, based on the structure in which the light guiding unit 4 is provided to not have the light reflecting layer 43, a total reflection of lights of the second light source 3 is ensured. Based on the structure in which the light guiding unit 4 is provided with the light reflecting layer 43, the second light source 3 has different degrees of light loss depending on the changes in the reflectivity of the light reflecting layer 43.

It should be noted that, when the light guiding unit 4 is the above-mentioned opaque light guiding plate, there is a visible dark area between the resulting low beam and high beam illumination patterns. When the light guiding unit 4 is the above-mentioned transparent light guiding block not having a light reflecting layer 43, the dark area between the resulting low beam and high beam illumination patterns becomes less visible. When the light guiding unit 4 is the above-mentioned transparent light guiding block having a light reflecting layer 43 on its bottom surface 42 thereof, the dark area between the resulting low beam and high beam illumination patterns can be eliminated.

Third Embodiment

Referring to FIG. 21 to FIG. 28, the third embodiment of the present disclosure provides a light projecting device P which includes a supporting unit 1, a first light source 2, a second light source 3, a light guiding unit 4 and a lens 5. The first light source 2 and the second light source 3 both are disposed on the supporting unit 1. The first light source 2 includes at least one first lighting unit 21 and a first reflecting unit 22 corresponding in position to the at least one first lighting unit 21. The second light source 3 includes at least one second lighting unit 31 and a second reflecting unit 32 corresponding in position to the at least one second lighting unit 31. The light guiding unit 4 is disposed in front of the supporting unit 1 and the lens 5 is disposed in front of the light guiding unit 4. It is worth mentioning that, the first lighting unit 21 has a first light emitting surface 211 and the second lighting unit 31 has a second light emitting surface 311, and the light emitting direction of the first light emitting surface 211 is opposite to that of the second light emitting surface 311 and the first light emitting surface 211 and the second light emitting surface 311 are coplanar with each other or in the vicinity of a plane. More specifically, the first light emitting surface 211 and the second light emitting surface 311 have a spacing therebetween that is between 0 mm and 5 mm, and preferably between 0 mm and 3.2 mm. Therefore, the light utilization efficiency of the light projecting device P can be increased while satisfying requirements for miniaturization.

The main difference between the present embodiment and the aforesaid embodiments is that the partitioning board 11 has at least one first partitioning portion 113 and at least one second partitioning portion 114. The technical details of the supporting unit 1, the first light source 2, the second light source 3, the light guiding unit 4 and the lens 5 are described in the aforesaid embodiments, and will not be reiterated herein. The first partitioning portion 113 can be located higher or lower than the second partitioning portion 114. The first partitioning portion 113 has a first supporting surface 11*a*, and the first light source 2 is disposed on the first supporting surface 11*a*. The second partitioning portion 114 has a second supporting surface 11*b* located at a different side from the first supporting surface 11*a*, and the second light source 3 is disposed on the first supporting surface 11*a*.

Figure 21:
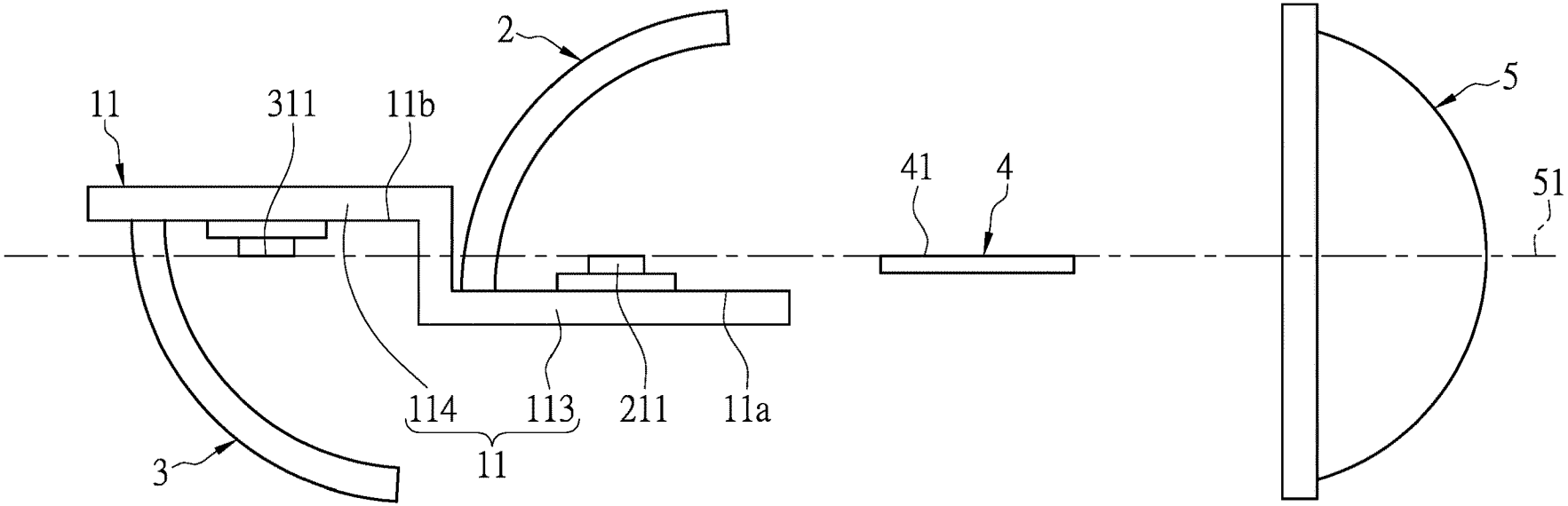
FIG. 21 is a planar view of an implementation example of a light projecting device having high light utilization efficiency according to a third embodiment of the present disclosure.
Figure 22:
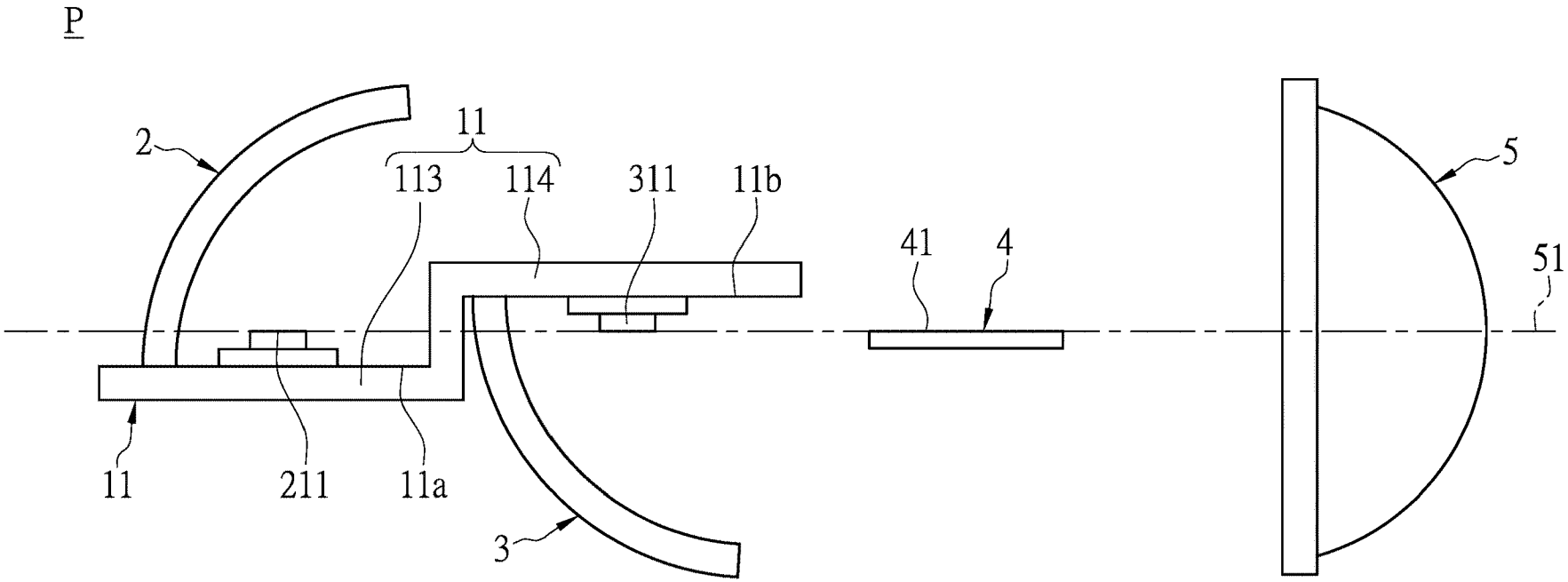
FIG. 22 is another planar view of the implementation example of the light projecting device according to the third embodiment of the present disclosure.

More specifically, based on the structure in which the first partitioning portion 113 is located higher or lower than the second partitioning portion 114, the present embodiment provides different optical designs as follows. One of the optical designs is that, as shown in FIG. 21, the light guiding unit 4 is an opaque light guiding plate, and the first light source 2 is disposed to be closer to the light guiding unit 4 than the second light source 3. A lens optical axis 51 can pass through a top surface 41 of the light guiding unit 4, the first light emitting surface 211 and the second light emitting surface 311. Another one of the optical designs is that, as shown in FIG. 22, the opaque light guiding plate serves as the light guiding unit 4, but the second light source 3 is disposed to be closer to the light guiding unit 4 than the first light source 2. The lens optical axis 51 can pass through the top surface 41 of the light guiding unit 4, the first light emitting surface 211 and the second light emitting surface 311.

Figure 23:
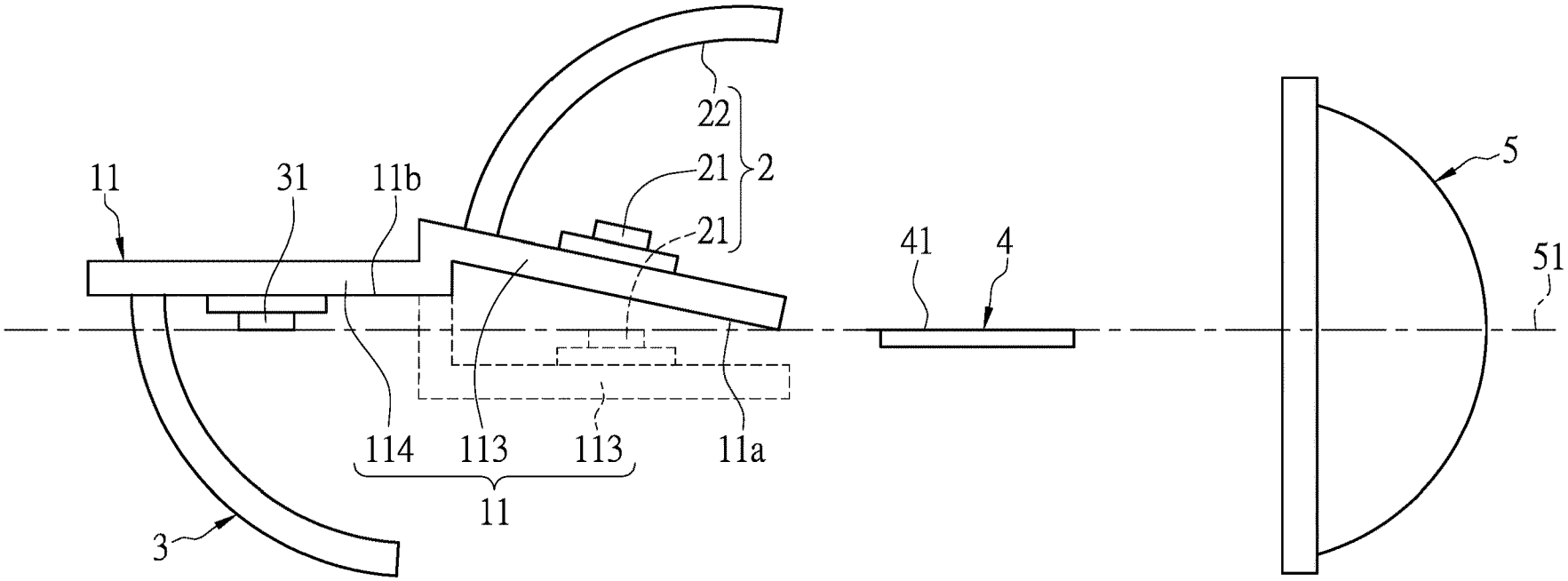
FIG. 23 is still another planar view of the implementation example of the light projecting device according to the third embodiment of the present disclosure.
Figure 24:
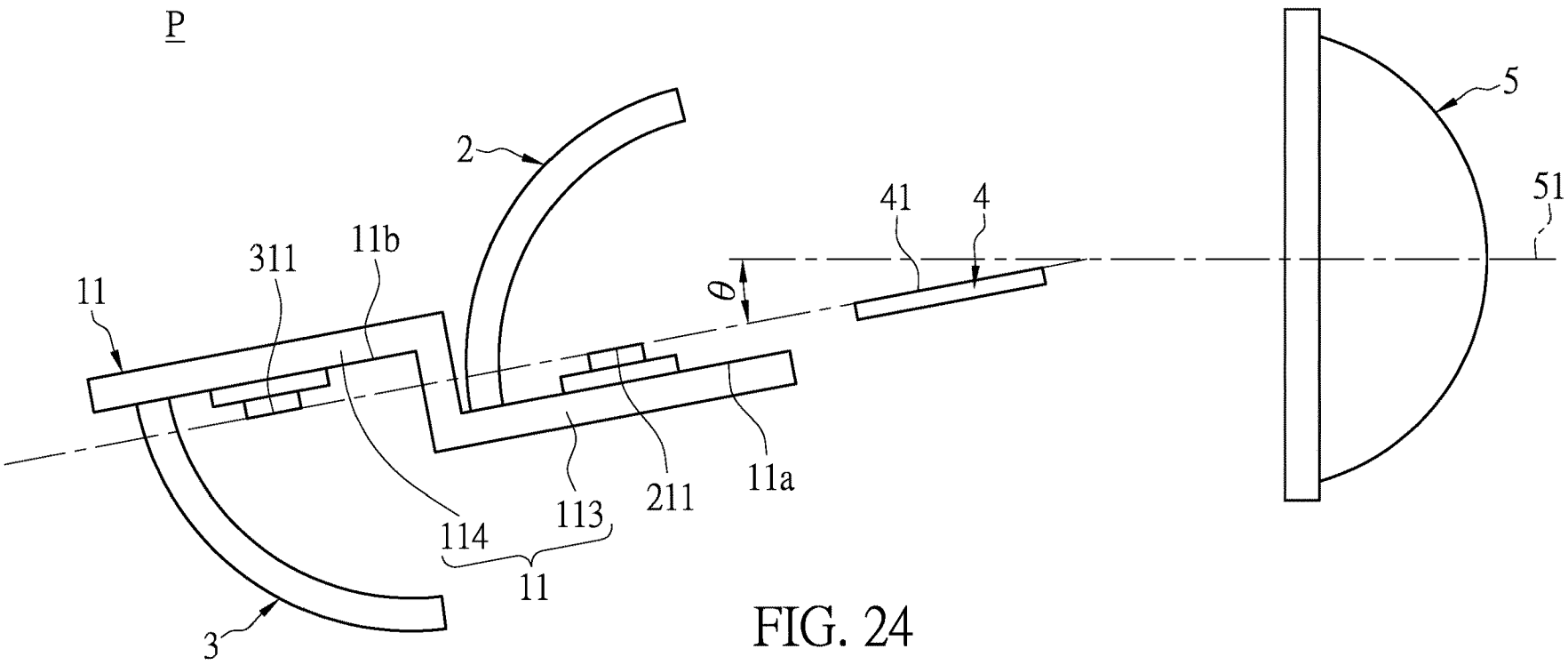
FIG. 24 is still another planar view of the implementation example of the light projecting device according to the third embodiment of the present disclosure.

Still another one of the optical designs is that, as shown in FIG. 23, the opaque light guiding plate serves as the light guiding unit 4, but the partitioning board 11 has a number of first partitioning portions 113 for correspondingly disposing the first lighting units 21 of the first light source 2, and one of the first partitioning portions 113 is inclined relative to the second partitioning portion 114. Accordingly, the first lighting unit 21 on the inclined first partitioning portion 113 and one portion of the first reflecting unit 22 can be used together to condense lights, and other first lighting units 21 and another portion of the first reflecting unit 22 can be used together to diffuse lights. Still another one of the optical designs is that, as shown in FIG. 24, the opaque light guiding plate serves as the light guiding unit 4, but the first partitioning portion 113 and the second partitioning portion 114 are inclined relative to the lens optical axis 51. Accordingly, the first light emitting surface 211, the second light emitting surface 311 and the top surface 41 of the light guiding unit 4 have a predetermined angle θ between 0 and 30 degrees relative to the lens optical axis 51.

Figure 25:
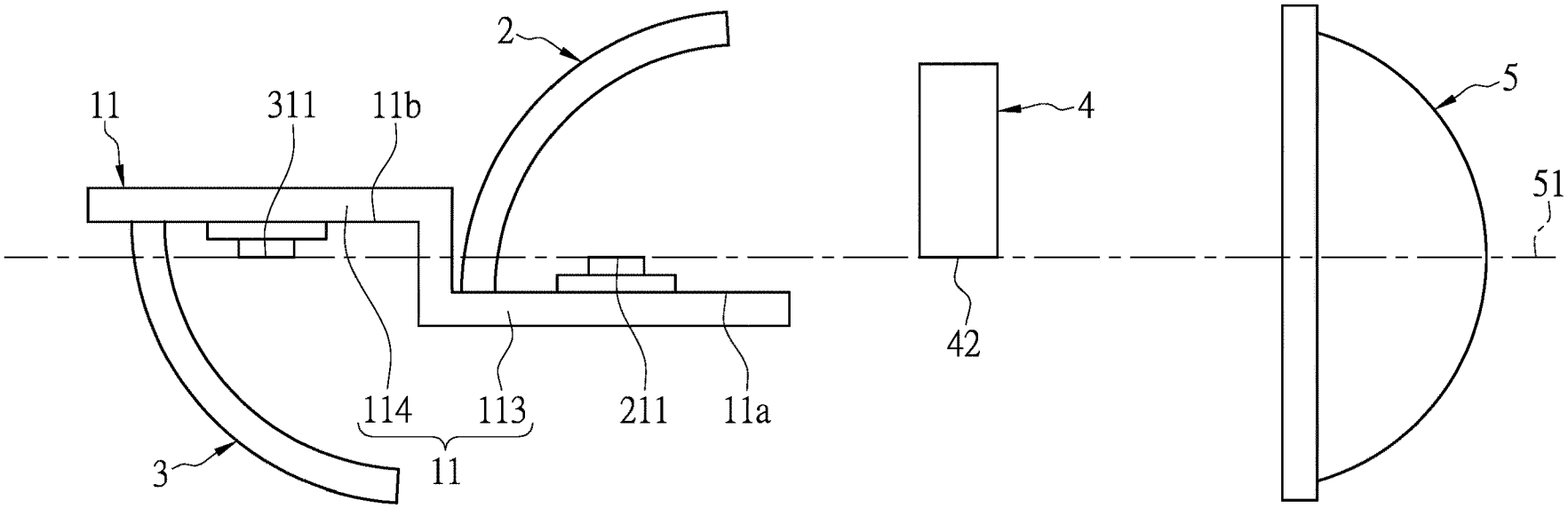
FIG. 25 is a planar view of another implementation example of the light projecting device according to the third embodiment of the present disclosure.
Figure 26:
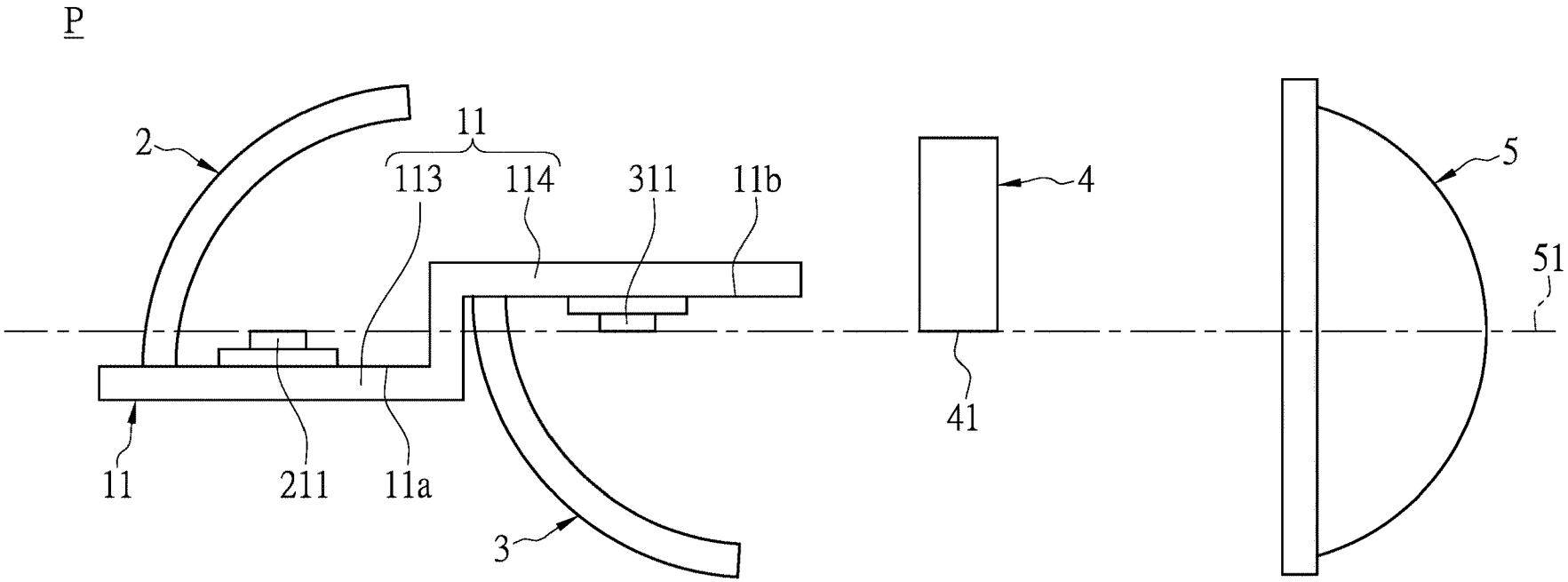
FIG. 26 is another planar view of the another implementation example of the light projecting device according to the third embodiment of the present disclosure.

Still another one of the optical designs is that, as shown in FIG. 25, the light guiding unit 4 is a transparent light guiding block, and the first light source 2 is disposed to be closer to the light guiding unit 4 than the second light source 3. The lens optical axis 51 can pass through a bottom surface 42 of the light guiding unit 4, the first light emitting surface 211 and the second light emitting surface 311. Still another one of the optical designs is that, as shown in FIG. 26, the transparent light guiding block serves as the light guiding unit 4, but the second light source 3 is disposed to be closer to the light guiding unit 4 than the first light source 2. The lens optical axis 51 can pass through the bottom surface 42 of the light guiding unit 4, the first light emitting surface 211 and the second light emitting surface 311.

Figure 27:
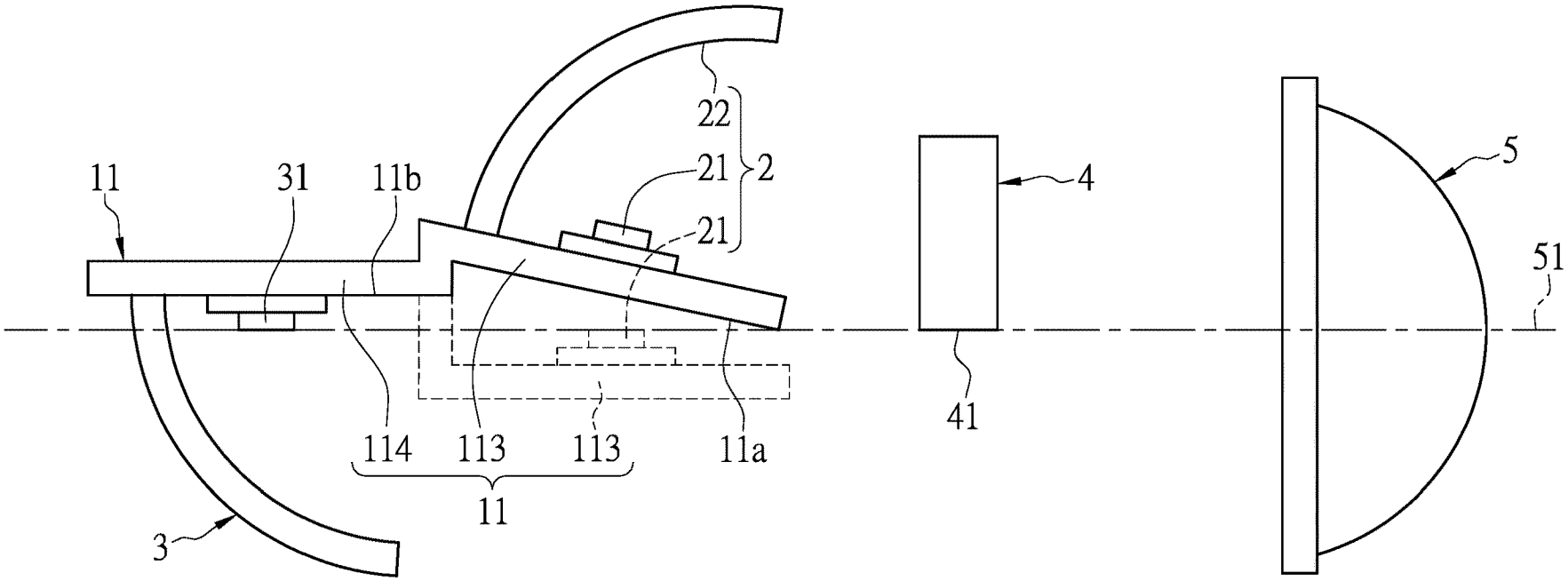
FIG. 27 is still another planar view of the another implementation example of the light projecting device according to the third embodiment of the present disclosure.
Figure 28:
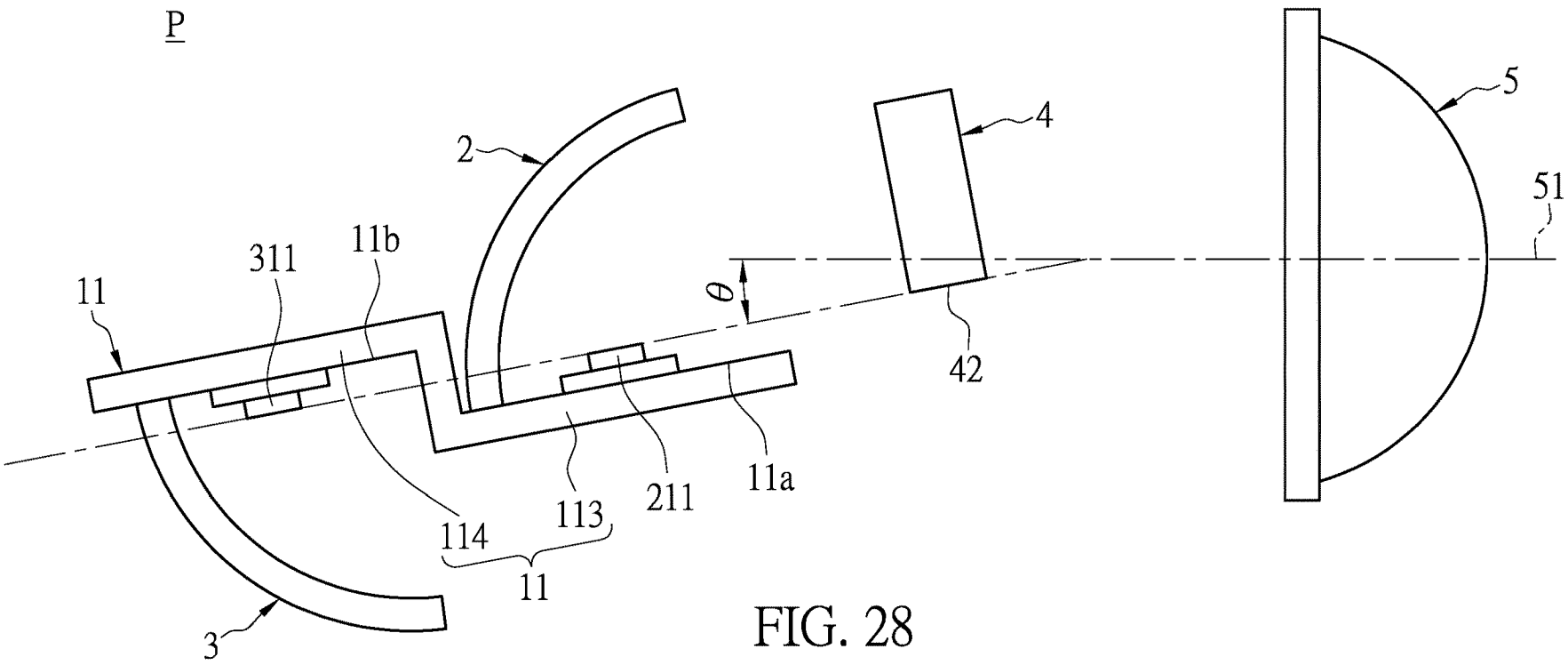
FIG. 28 is still another planar view of the another implementation example of the light projecting device according to the third embodiment of the present disclosure.

Still another one of the optical designs is that, as shown in FIG. 27, the transparent light guiding block serves as the light guiding unit 4, but the partitioning board 11 has a number of first partitioning portions 113 for correspondingly disposing the first lighting units 21 of the first light source 2, and one of the first partitioning portions 113 is disposed to be inclined relative to the second partitioning portion 114. Accordingly, the first lighting unit 21 on the inclined first partitioning portion 113 and one portion of the first reflecting unit 22 can be used together to condense lights, and other first lighting units 21 and another portion of the first reflecting unit 22 can be used together to diffuse lights. Still another one of the optical designs is that, as shown in FIG. 28, the transparent light guiding block serves as the light guiding unit 4, but the first partitioning portion 113 and the second partitioning portion 114 are inclined relative to the lens optical axis 51. Accordingly, the first light emitting surface 211, the second light emitting surface 311 and the bottom surface 42 of the light guiding unit 4 have a predetermined angle θ between 0 and 30 degrees relative to the lens optical axis 51.

Fourth Embodiment

Figure 29:
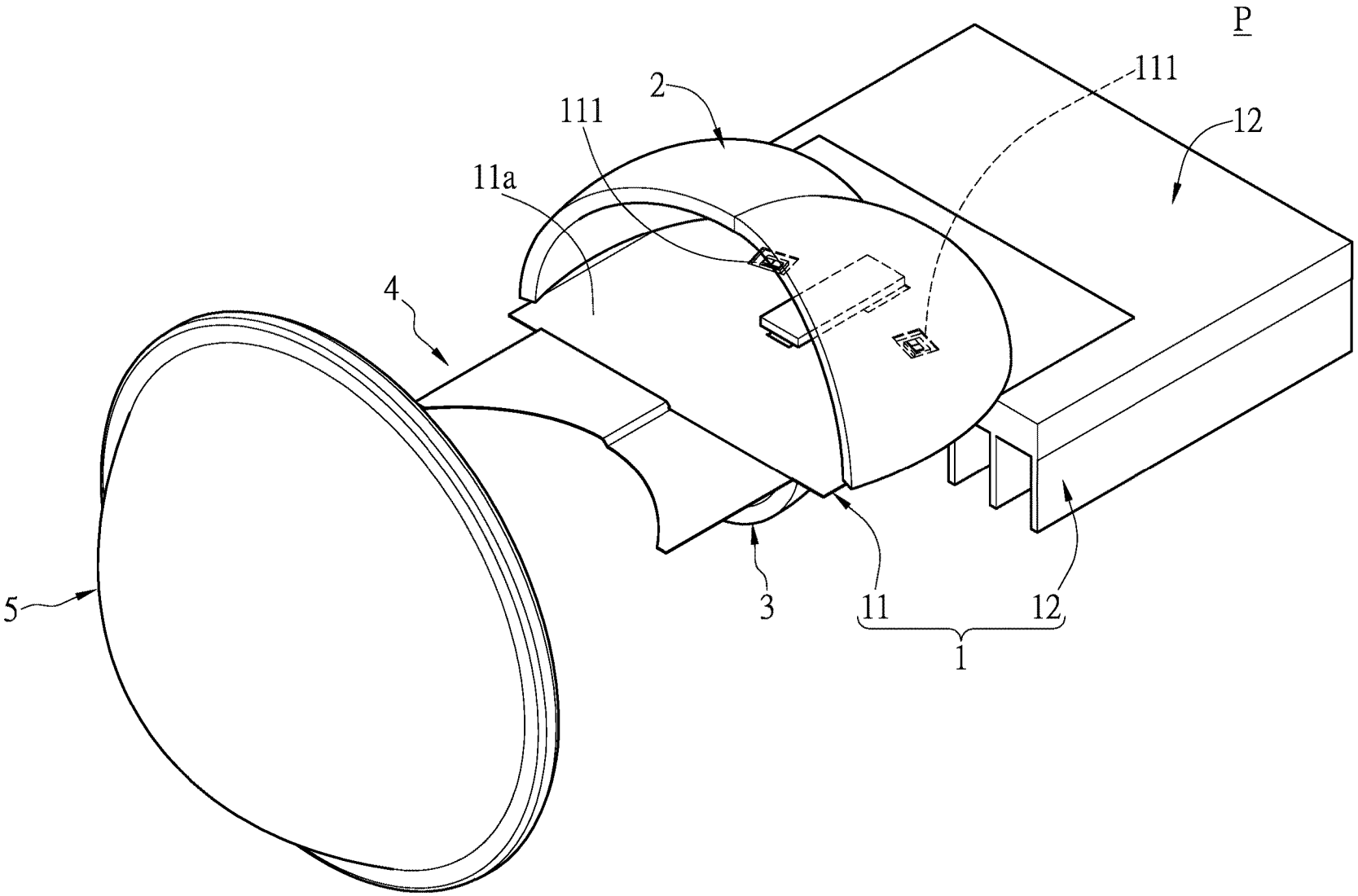
FIG. 29 is an assembled perspective view of a light projecting device having high light utilization efficiency according to a fourth embodiment of the present disclosure.
Figure 30:
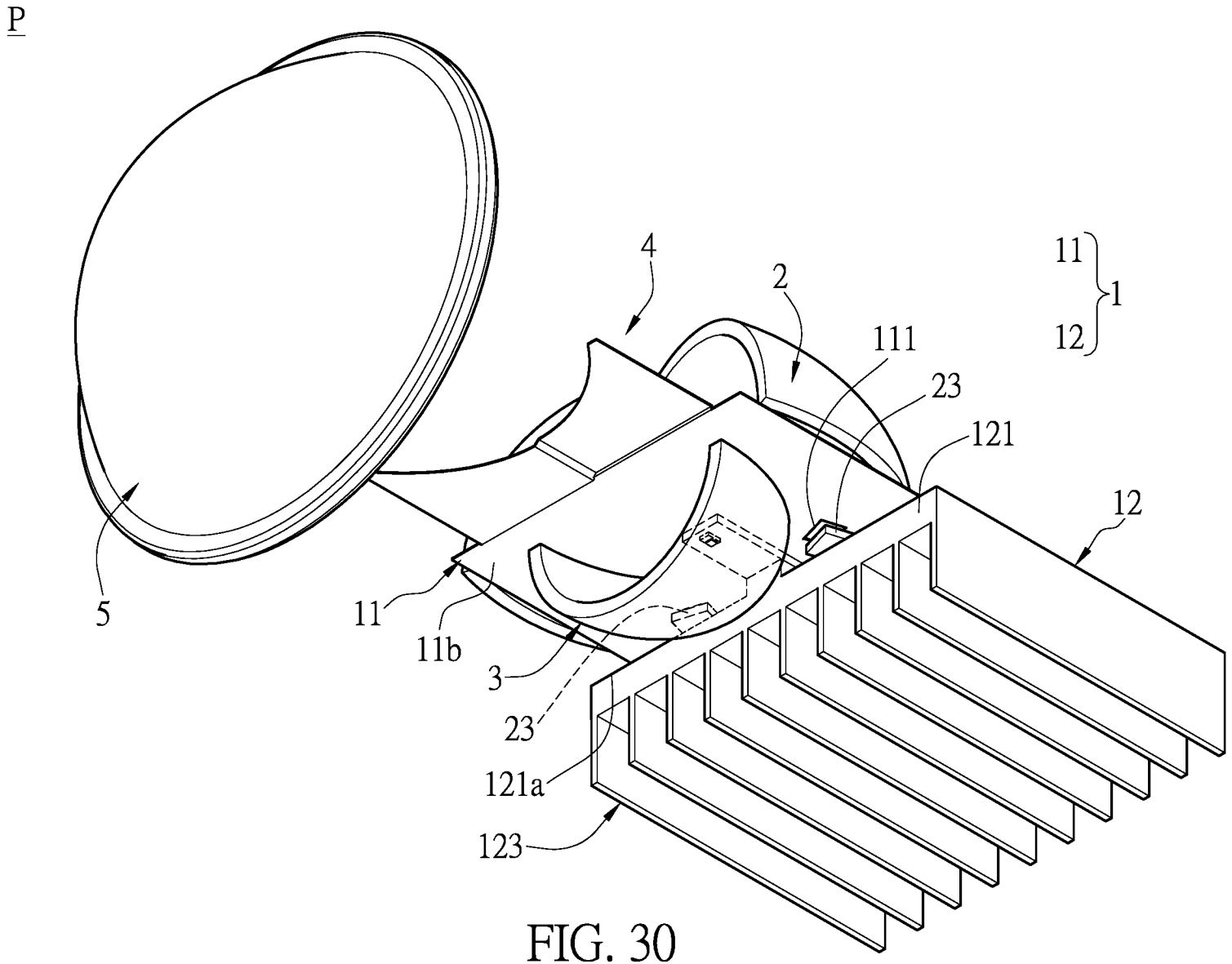
FIG. 30 is another assembled perspective view of the light projecting device according to the fourth embodiment of the present disclosure.
Figure 31:
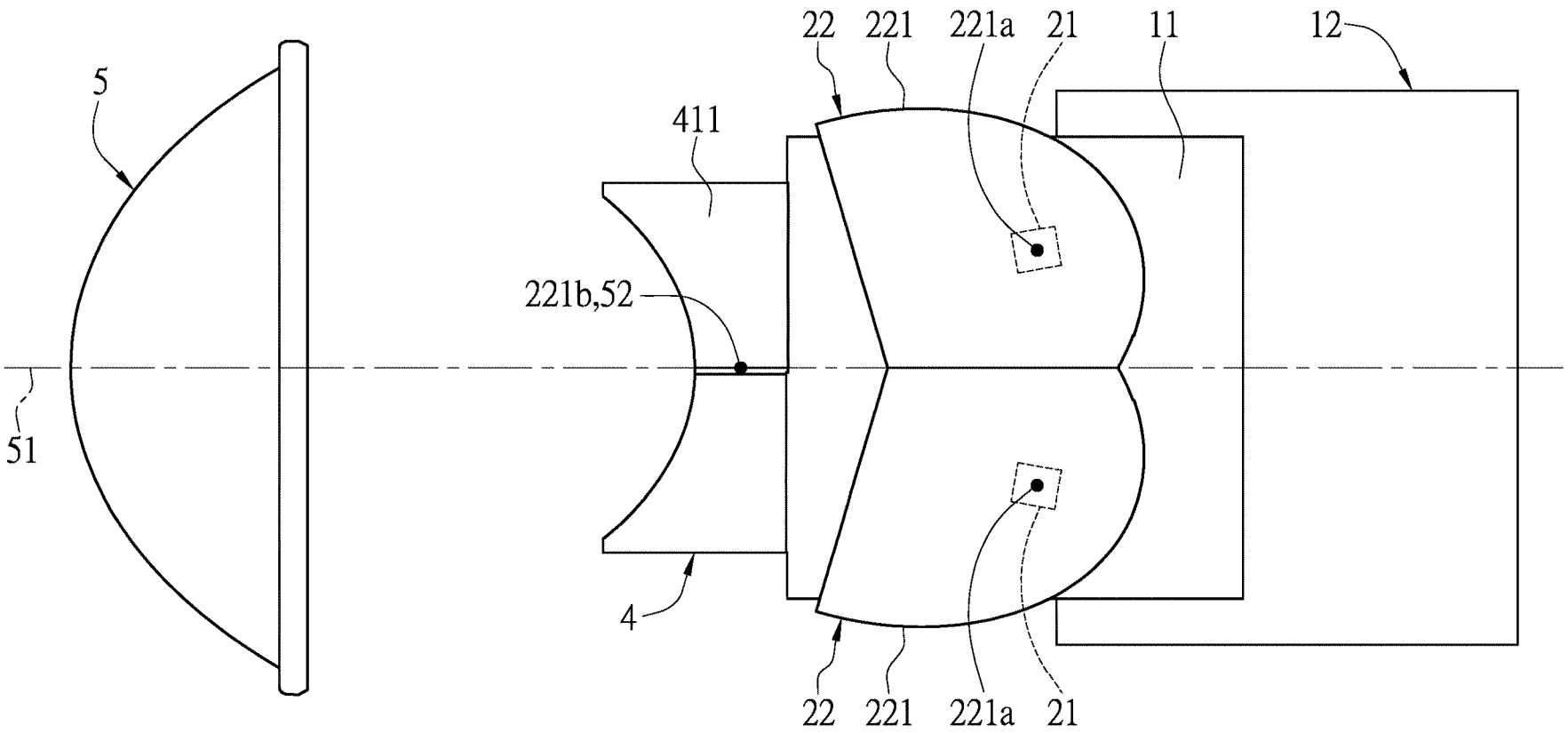
FIG. 31 is a bottom view of the light projecting device according to the fourth embodiment of the present disclosure.
Figure 32:
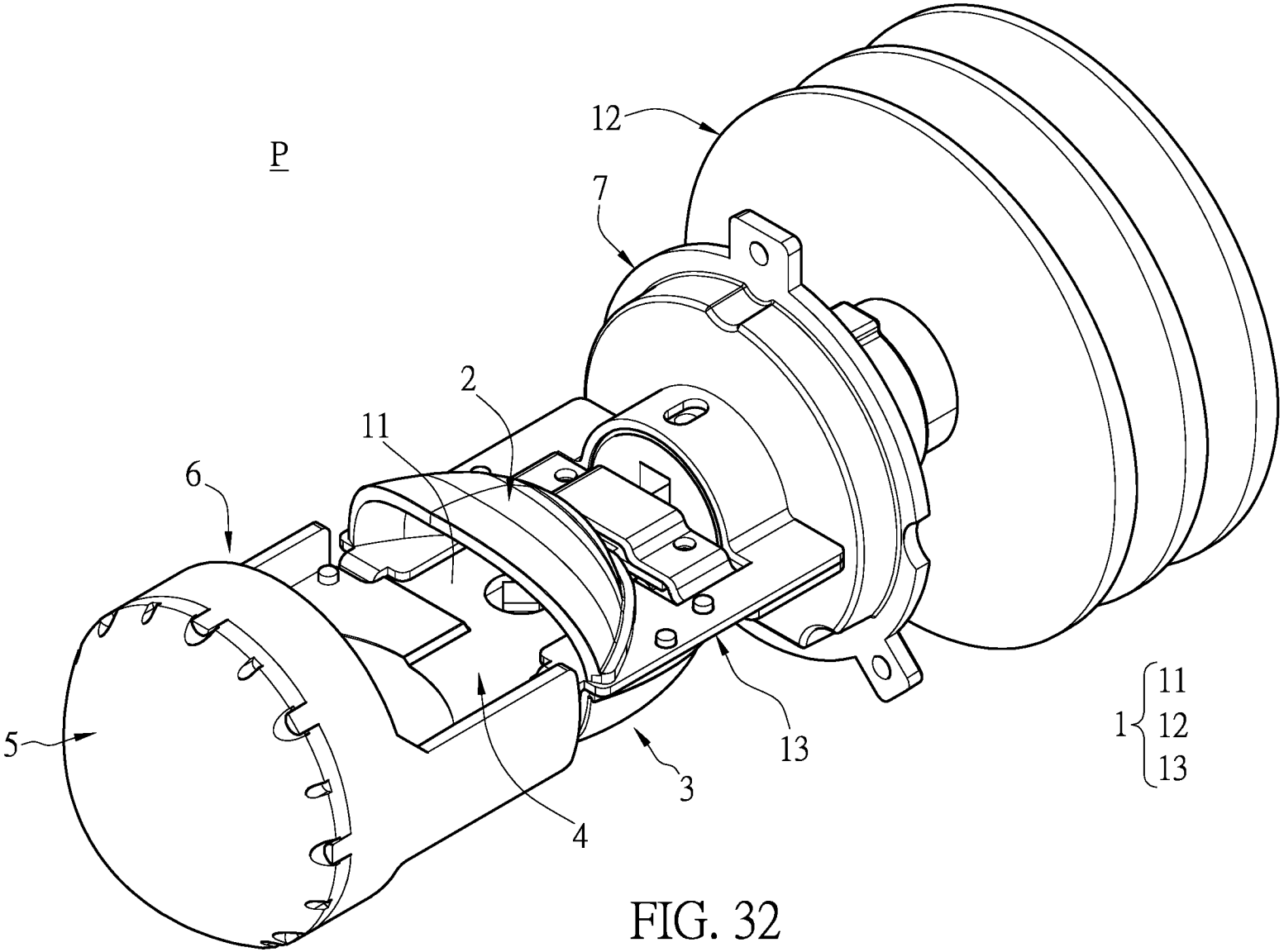
FIG. 32 is an assembled perspective view of an implementation example of a light projecting device having high light utilization efficiency according to a fifth embodiment of the present disclosure.
Figure 33:
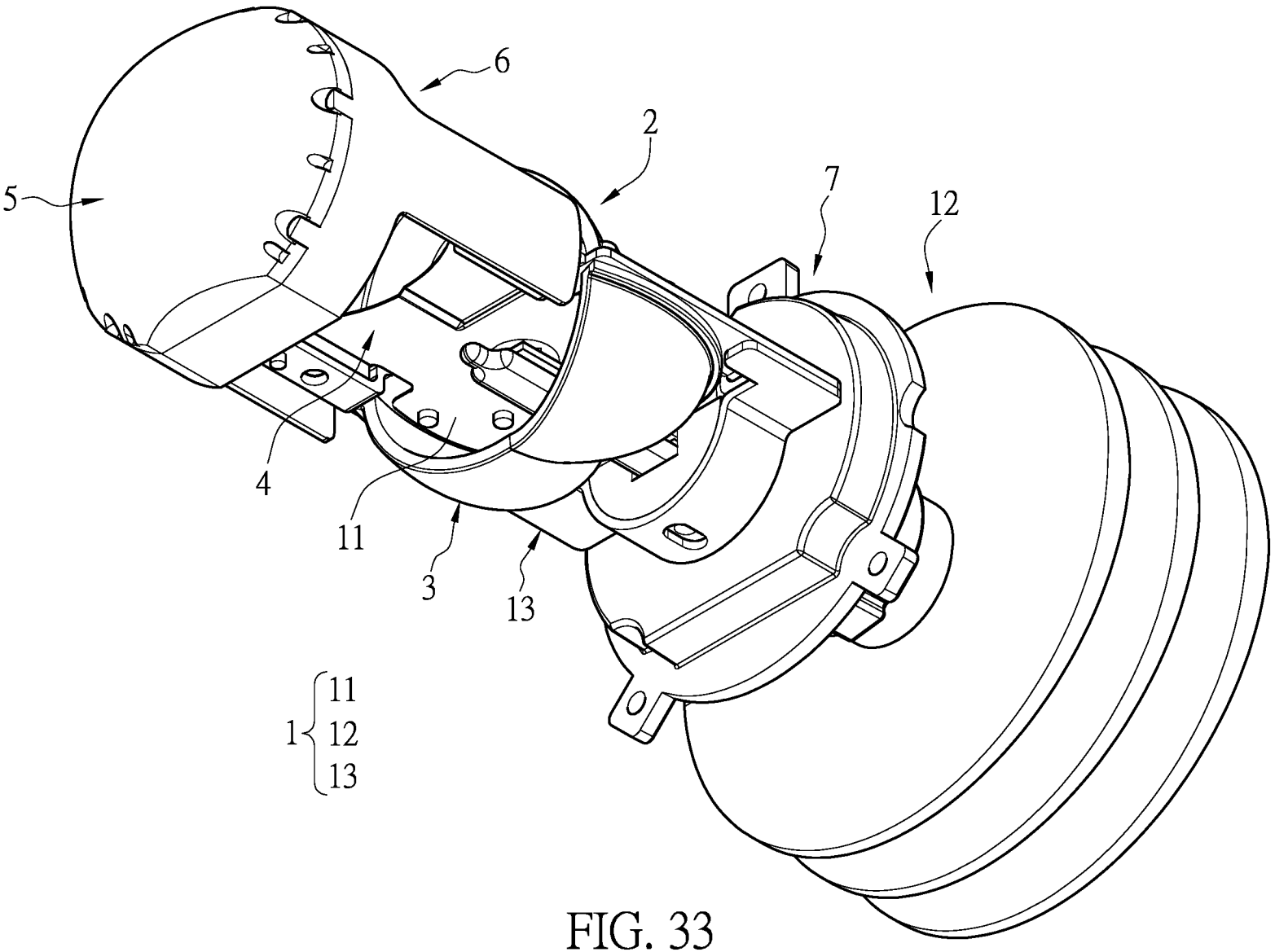
FIG. 33 is another assembled perspective view of the implementation example of the light projecting device according to the fifth embodiment of the present disclosure.
Figure 34:
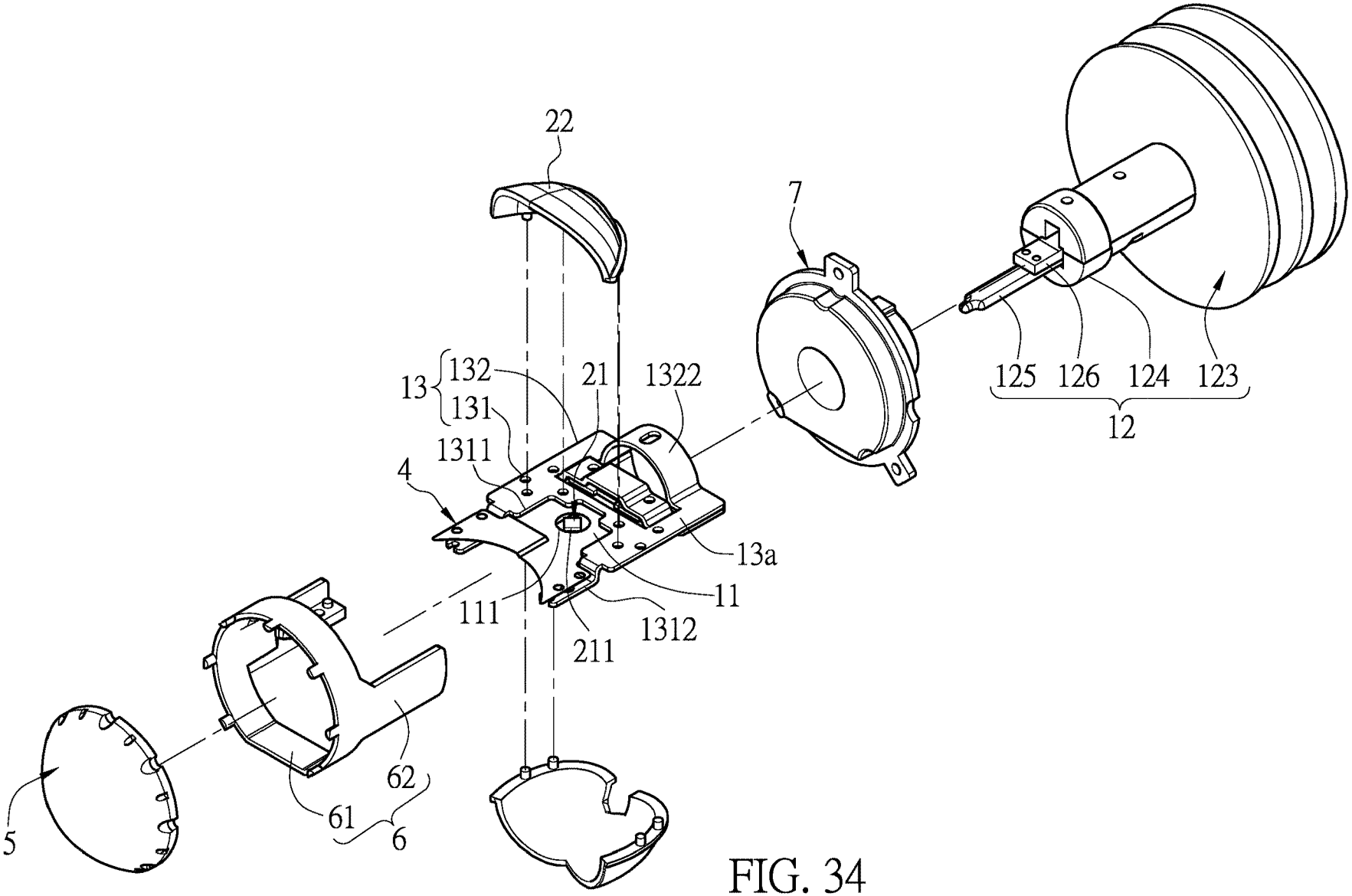
FIG. 34 is an exploded perspective view of the implementation example of the light projecting device according to the fifth embodiment of the present disclosure.
Figure 35:
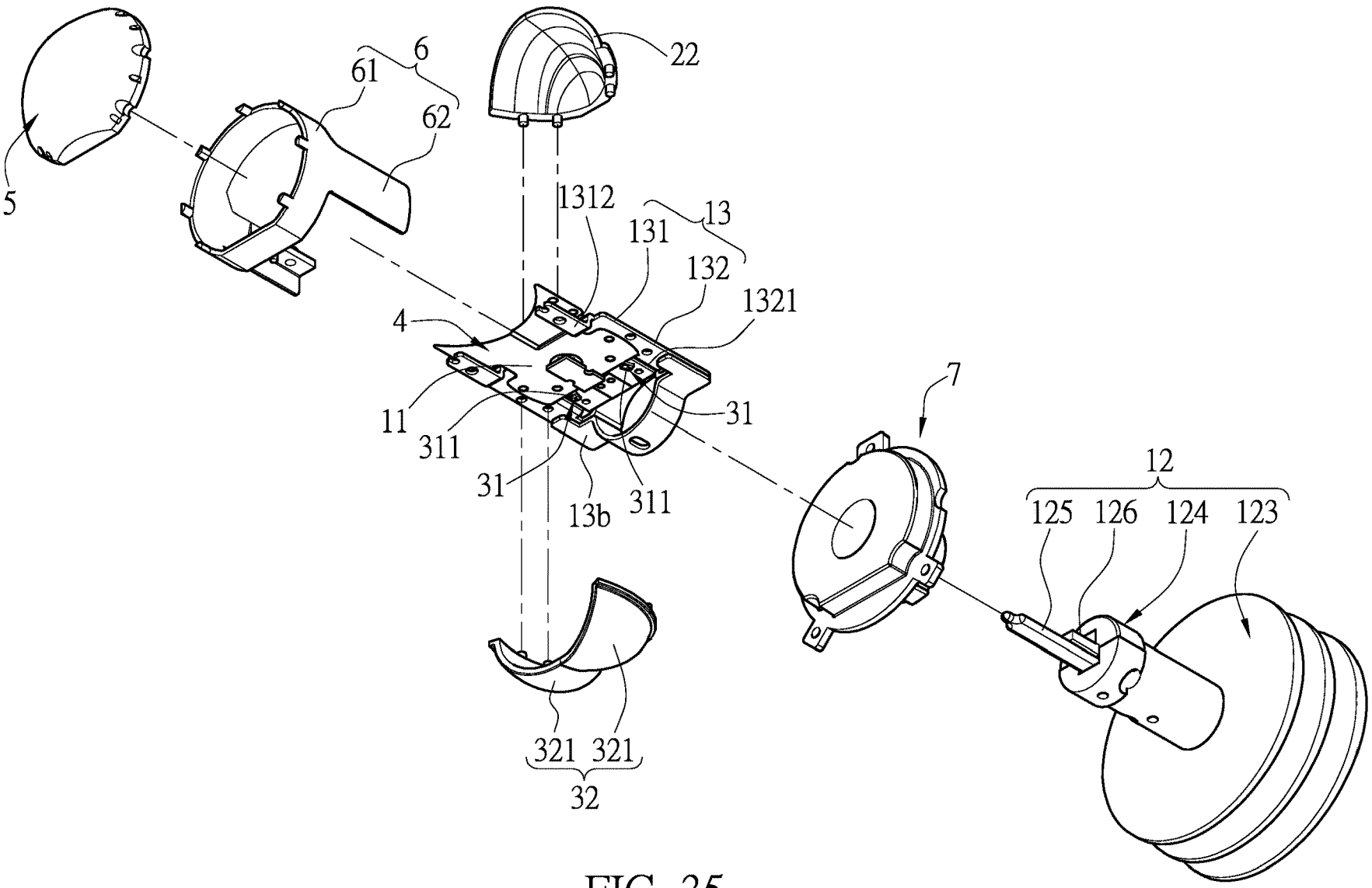
FIG. 35 is another exploded perspective view of the implementation example of the light projecting device according to the fifth embodiment of the present disclosure.
Figure 36:
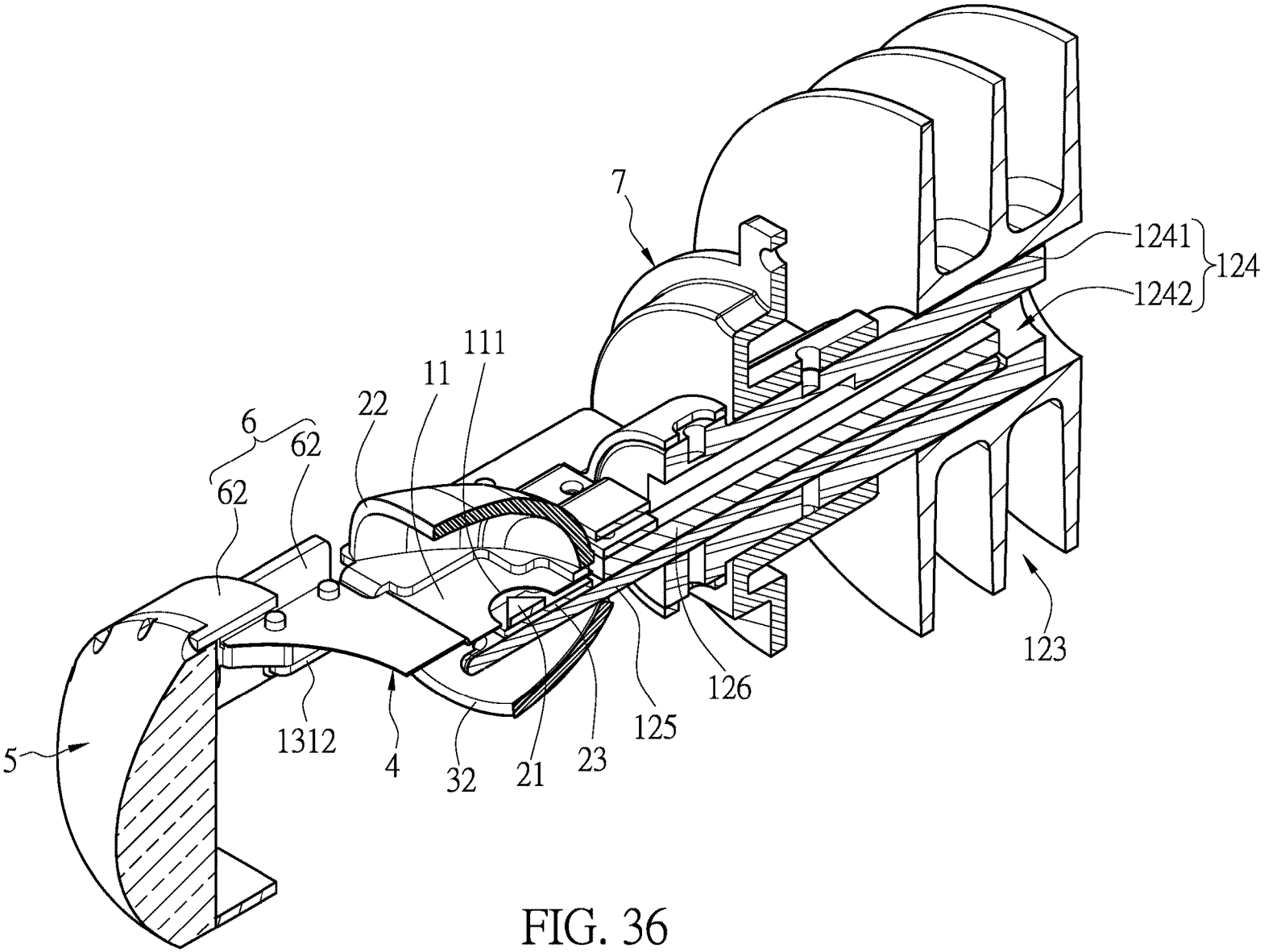
FIG. 36 is a perspective sectional view of the implementation example of the light projecting device according to the fifth embodiment of the present disclosure.
Figure 37:
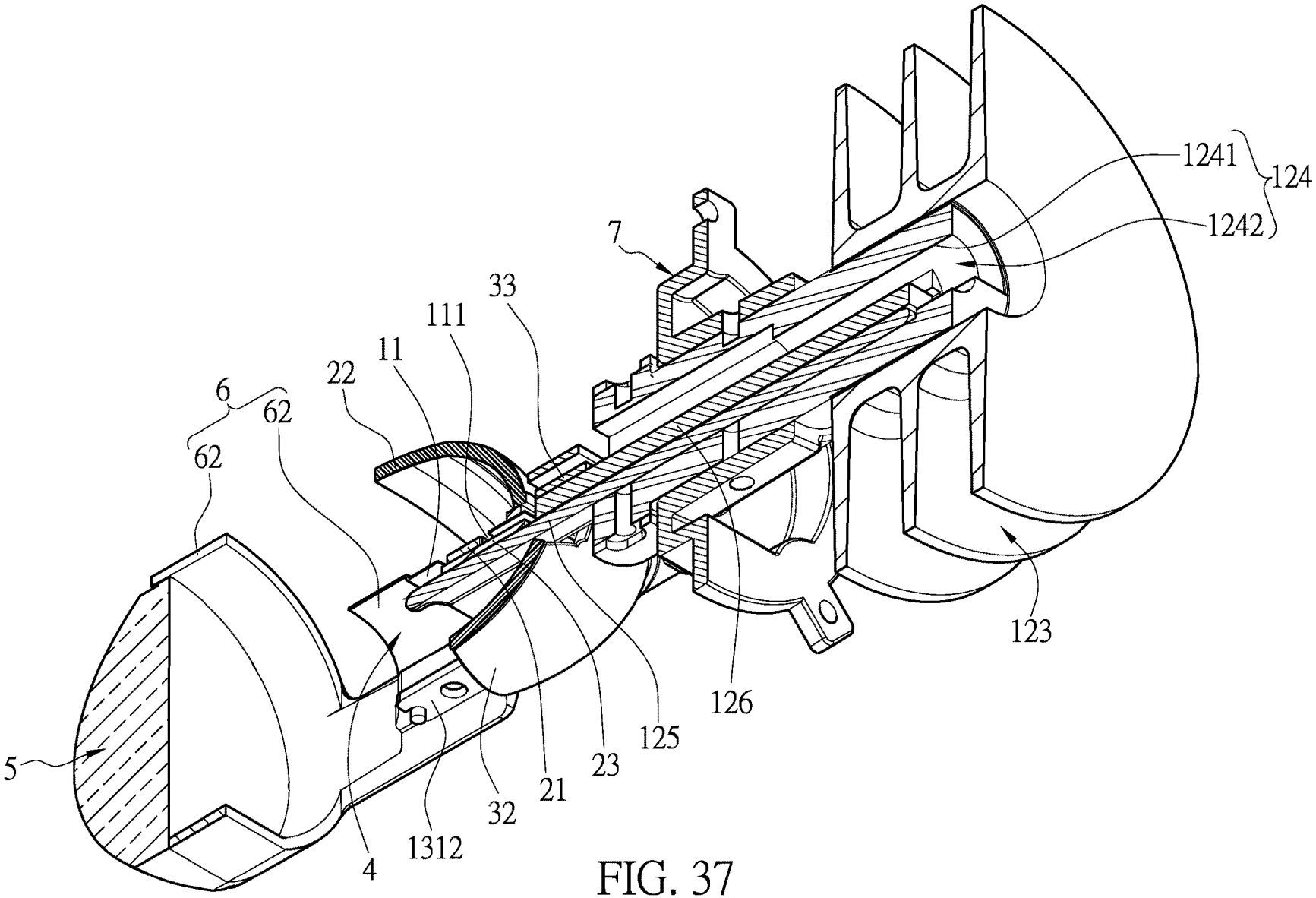
FIG. 37 is another perspective sectional view of the implementation example of the light projecting device according to the fifth embodiment of the present disclosure.
Figure 38:
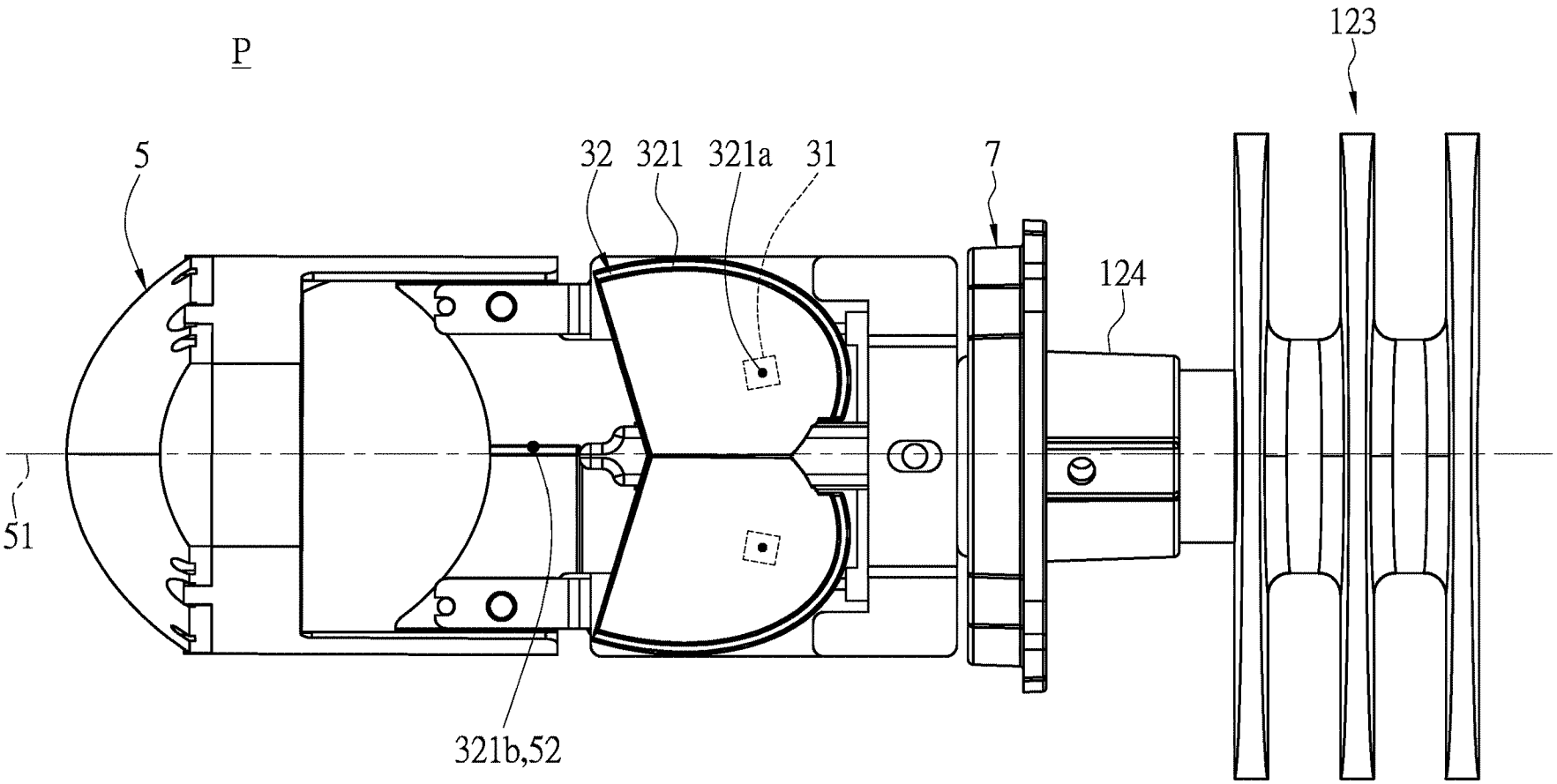
FIG. 38 is a bottom view of the implementation example of the light projecting device according to the fifth embodiment of the present disclosure.
Figure 39:
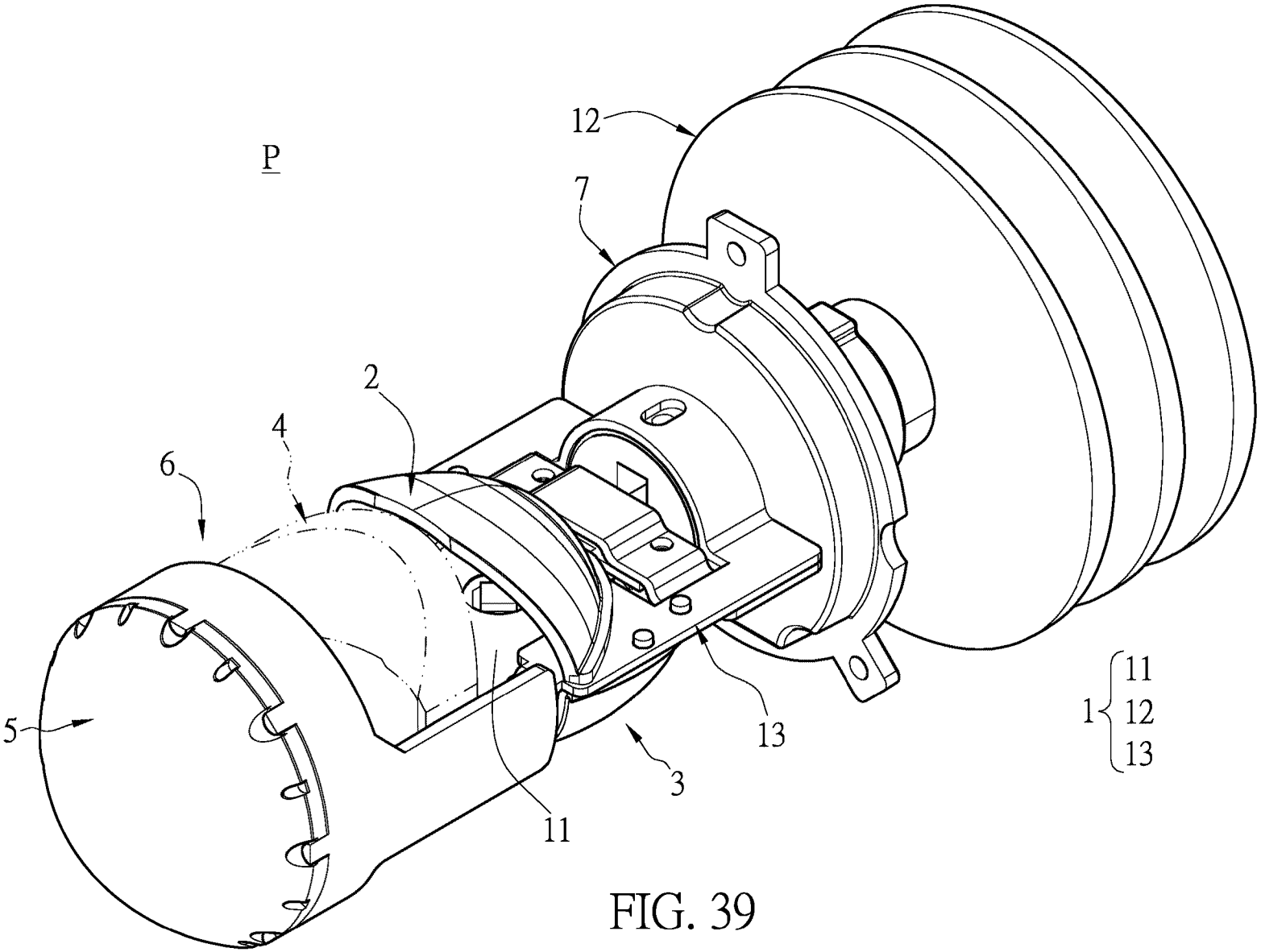
FIG. 39 is an assembled perspective view of another implementation example of the light projecting device according to the fifth embodiment of the present disclosure.
Figure 40:
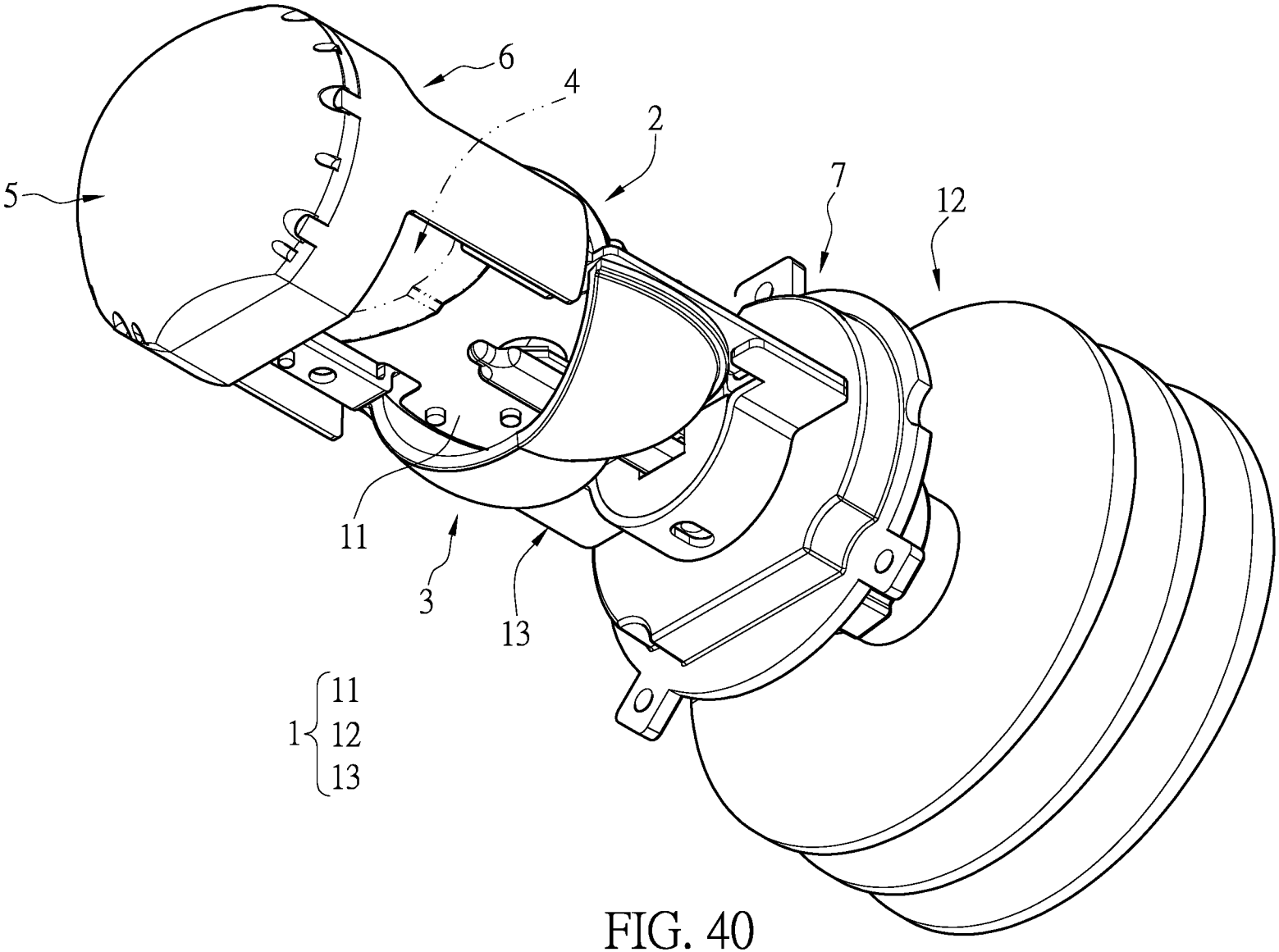
FIG. 40 is another assembled perspective view of the another implementation example of the light projecting device according to the fifth embodiment of the present disclosure.
Figure 41:
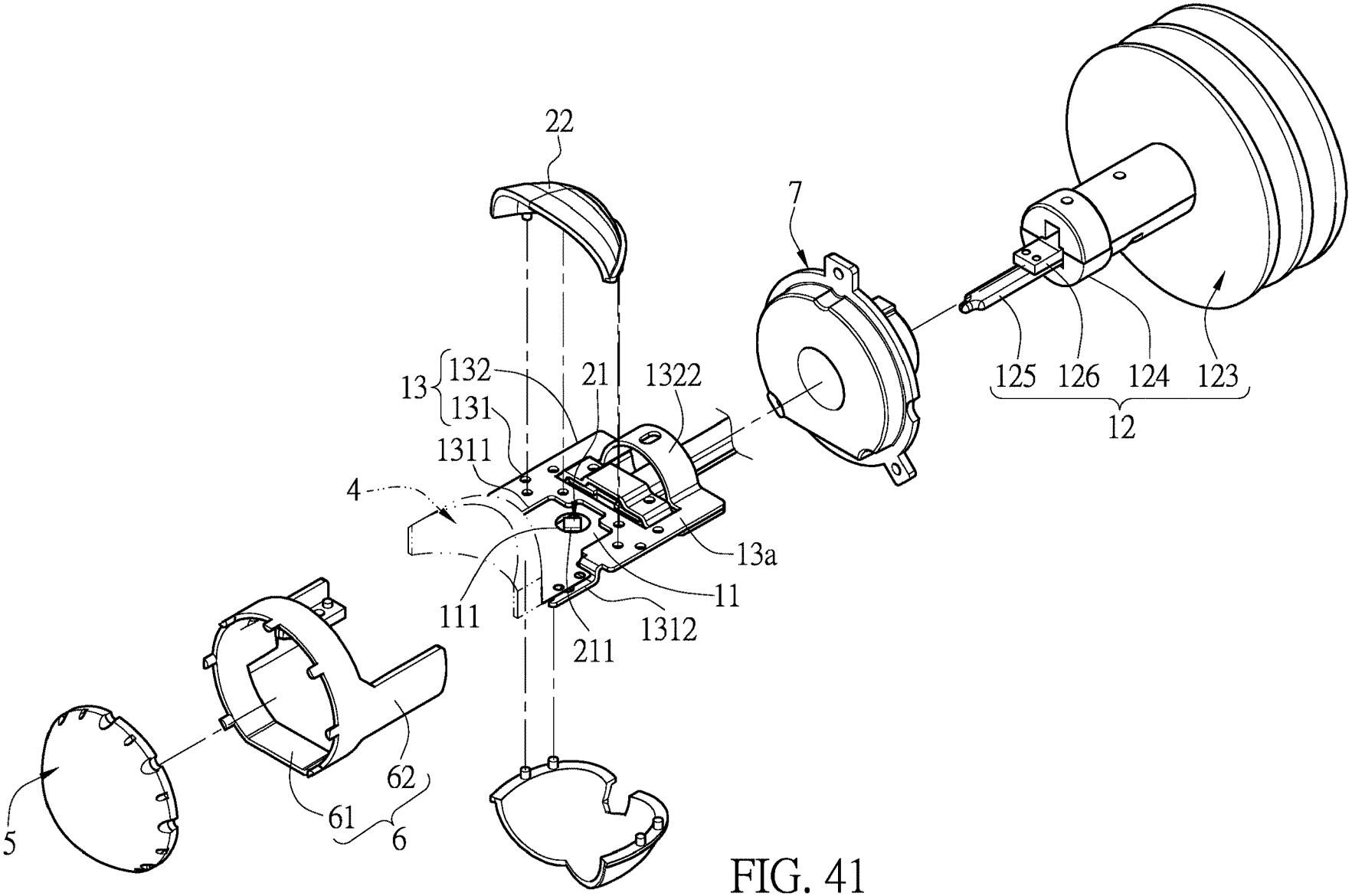
FIG. 41 is an exploded perspective view of the another implementation example of the light projecting device according to the fifth embodiment of the present disclosure.
Figure 42:
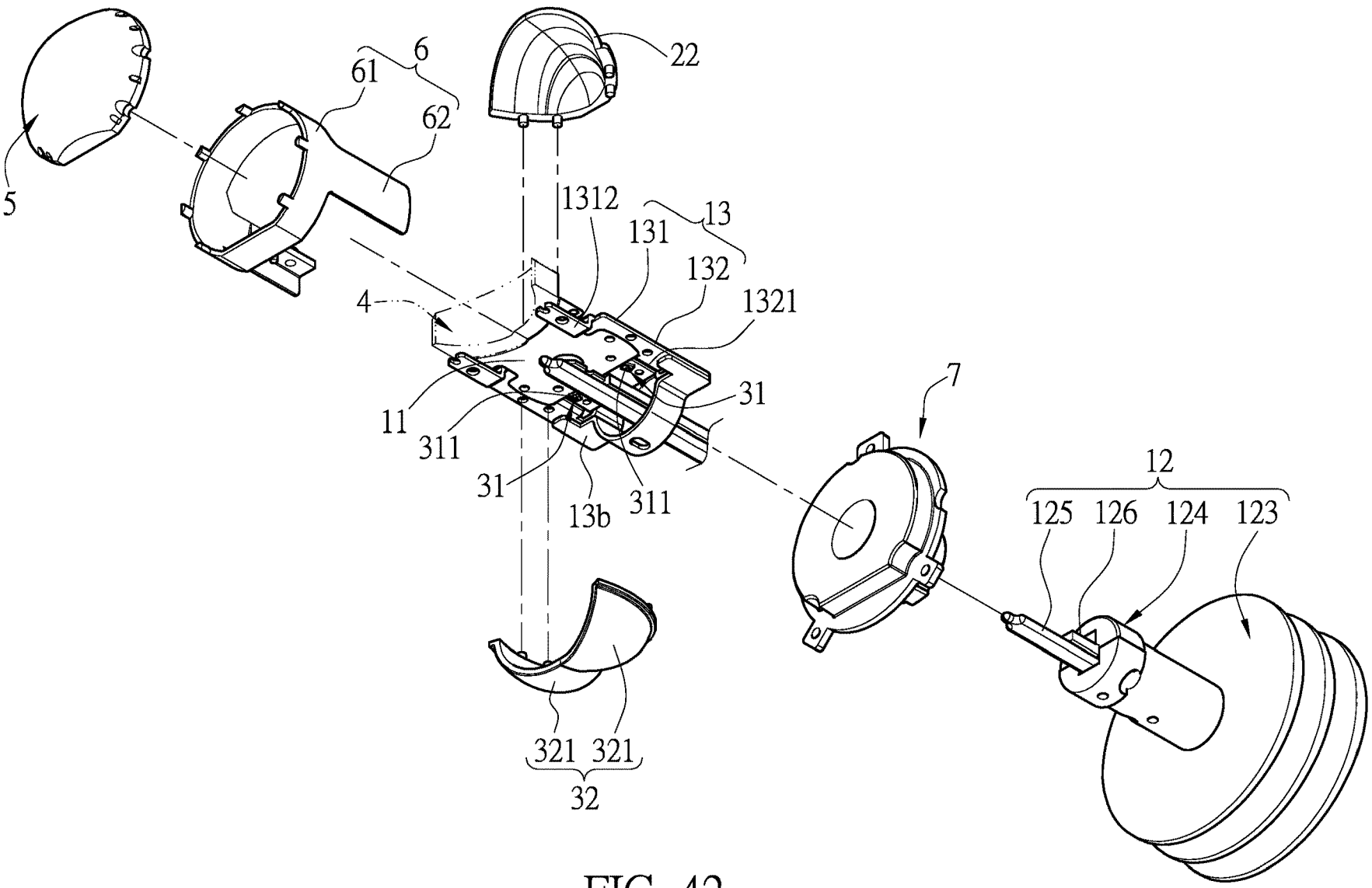
FIG. 42 is another exploded perspective view of the another implementation example of the light projecting device according to the fifth embodiment of the present disclosure.
Figure 43:
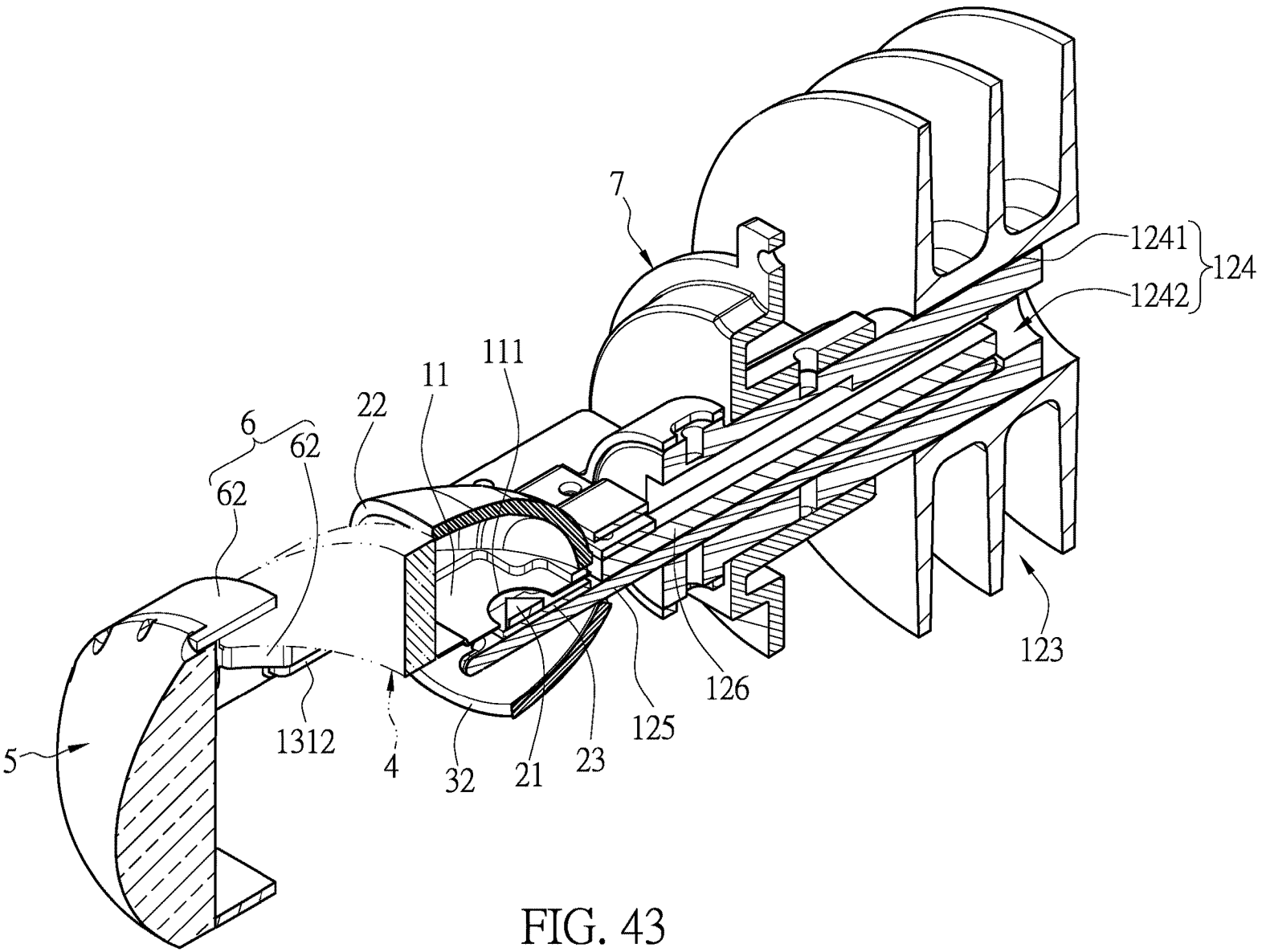
FIG. 43 is a perspective sectional view of the another implementation example of the light projecting device according to the fifth embodiment of the present disclosure.
Figure 44:
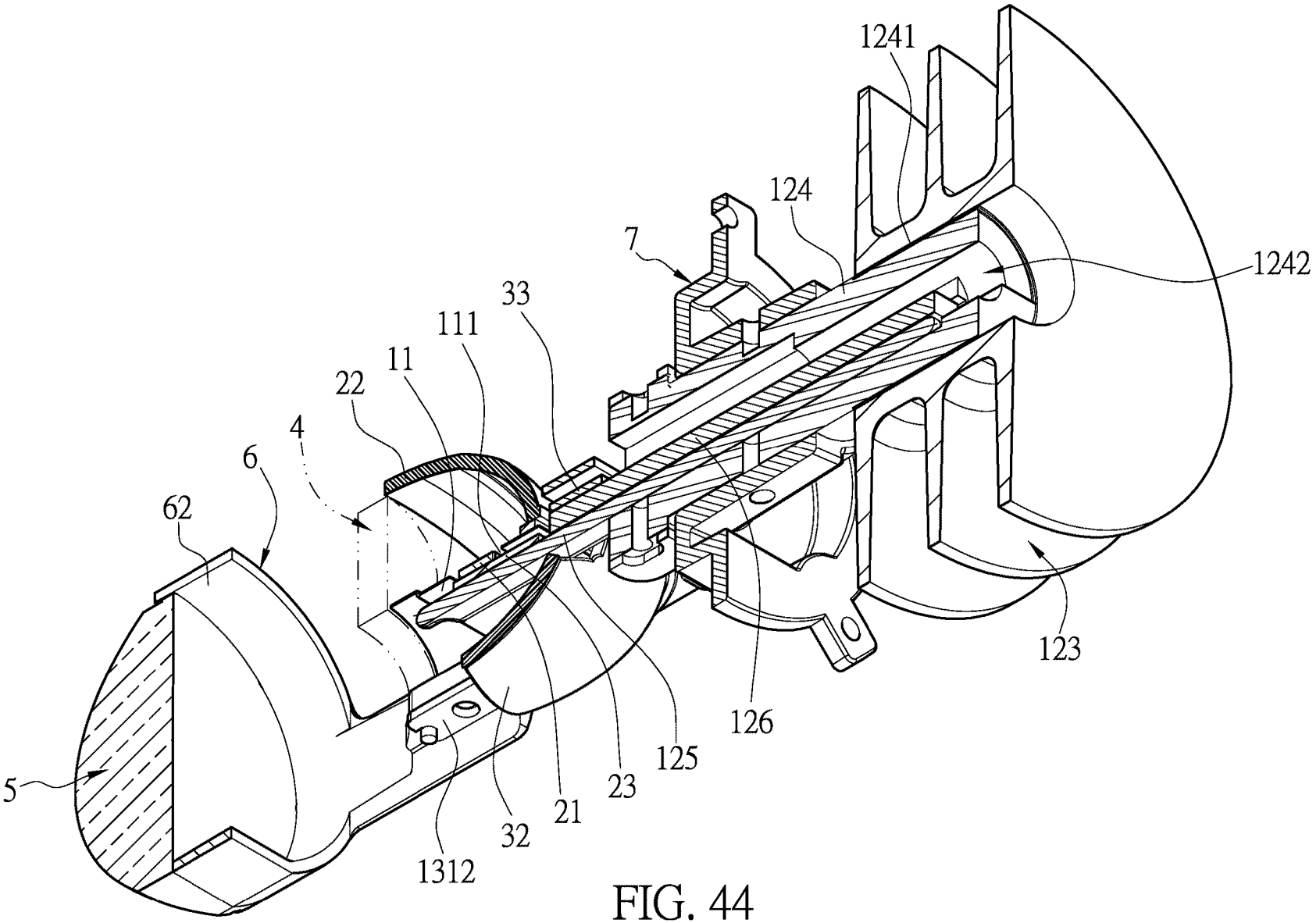
FIG. 44 is another perspective sectional view of the another implementation example of the light projecting device according to the fifth embodiment of the present disclosure.
Figure 45:
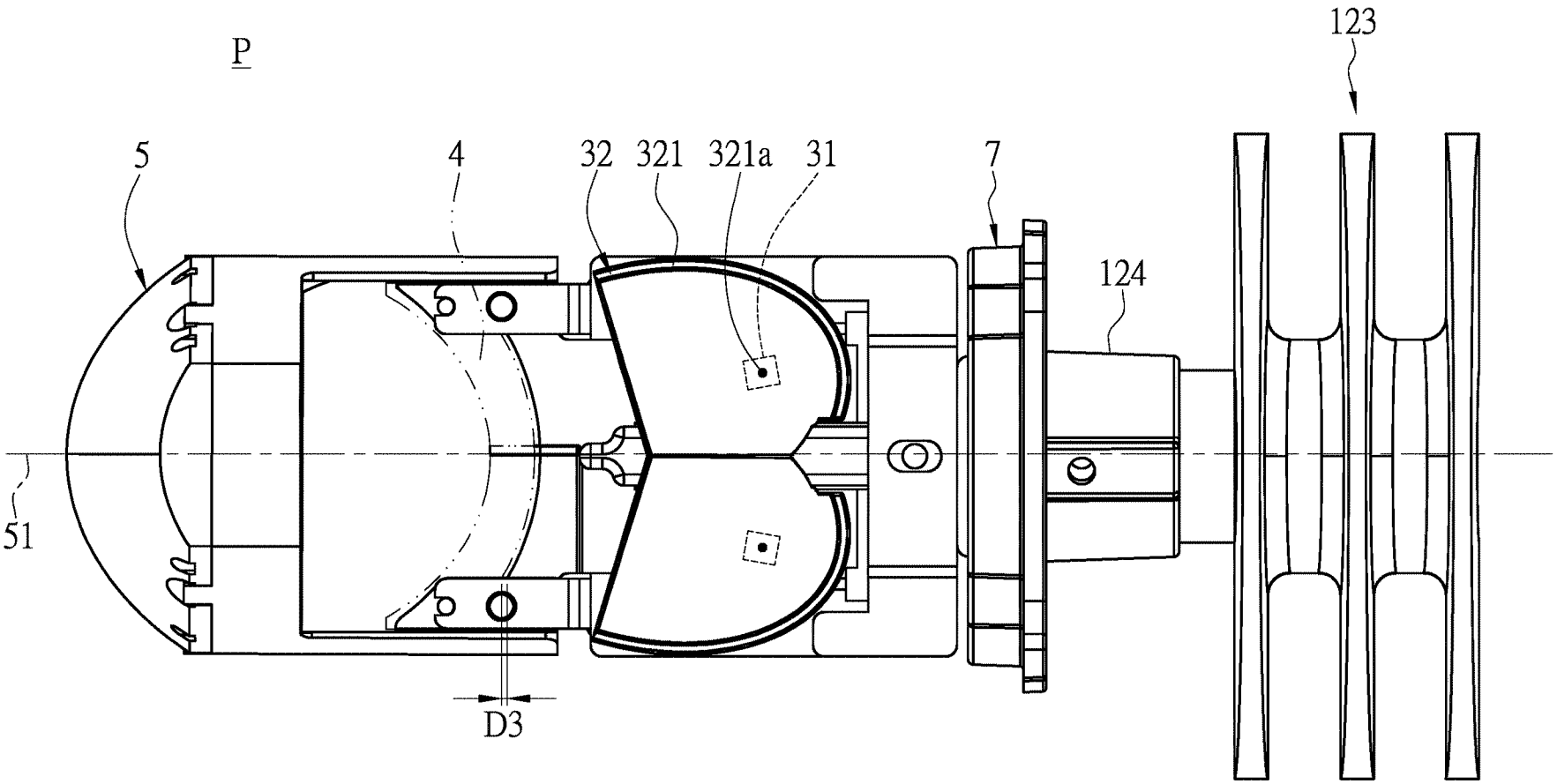
FIG. 45 is a bottom view of the another implementation example of the light projecting device according to the fifth embodiment of the present disclosure.

Referring to FIG. 29 to FIG. 31, the fourth embodiment of the present disclosure provides a light projecting device P which includes a supporting unit 1, a first light source 2, a second light source 3, a light guiding unit 4 and a lens 5. The first light source 2 and the second light source 3 both are disposed on the supporting unit 1. The first light source 2 includes at least one first lighting unit 21 and a first reflecting unit 22 corresponding in position to the at least one first lighting unit 21. The second light source 3 includes at least one second lighting unit 31 and a second reflecting unit 32 corresponding in position to the at least one second lighting unit 31. The light guiding unit 4 is disposed in front of the supporting unit 1 and the lens 5 is disposed in front of the light guiding unit 4. It is worth mentioning that, the first lighting unit 21 has a first light emitting surface 211 and the second lighting unit 31 has a second light emitting surface 311, and the light emitting direction of the first light emitting surface 211 is opposite to that of the second light emitting surface 311 and the first light emitting surface 211 and the second light emitting surface 311 are coplanar with each other or in the vicinity of a plane. More specifically, the first light emitting surface 211 and the second light emitting surface 311 have a spacing therebetween that is between 0 mm and 5 mm, and preferably between 0 mm and 3.2 mm. Therefore, the light utilization efficiency of the light projecting device P can be increased while satisfying requirements for miniaturization.

The main difference between the present embodiment and the aforesaid embodiments is that the first light source 2 includes two first lighting units 21 and the first reflecting unit 22 includes two first reflecting portions 221 that correspond in position to the two first lighting units 21 respectively. Therefore, the illumination strength of the low beam light can be increased. In the present embodiment, each of the two first reflecting portions 221 is part of a light reflecting cup and has a reflecting surface (not numbered) with only one curvature or a number of curvatures. The reflecting surface is, for example, a partial ellipsoidal surface or a composite ellipsoidal surface, but is not limited thereto. Each of the two first reflecting portions 221 has a first focal point 221*a* and a second focal point 221*b* corresponding in position to the first focal point 221*a*. Each first focal point 221*a* is located in a cover area of the corresponding first reflecting portion 221 and each second focal point 221*b* is located outside the cover area of the corresponding first reflecting portion 221. More specifically, the two second focal points 221*b* are located on a lens optical axis 51 and coincide with or substantially coincide with a lens focal point 52. Also, the two second focal points 221*b* can be deviated from the lens optical axis 51 and located in the vicinity of the lens focal point 52.

Each of the two first lighting units 21 is disposed on a first circuit board 23 and in the vicinity of the second supporting surface 11*b* of the partitioning board 11. The two first circuit boards 23 are disposed on a first heat transmitting surface 121*a* of a heat conducting board 121. Therefore, heat generated from the two first lighting units 21 can be uniformly transmitted to a plurality of heat dissipating fins 123 by the heat conducting board 121 so as to be quickly dissipated to an outer environment. Each of the two first lighting units 21 may be an LED or a package structure including a number of LEDs. The two first lighting units 21 can be respectively disposed on or in the vicinity of the two first focal points 221*a*. In order to allow the two first lighting units 21 to emit lights toward the two first reflecting portions 221, the partitioning board 11 of the supporting unit 1 has two first openings 111, such that the first light emitting surfaces 211 of the two first lighting units 21 can be exposed from the first supporting surface 11*a* through the two first openings 111 respectively.

Fifth Embodiment

Referring to FIG. 32 to FIG. 35 and FIG. 39 to FIG. 42, the fifth embodiment of the present disclosure provides a light projecting device P which includes a supporting unit 1, a first light source 2, a second light source 3, a light guiding unit 4 and a lens 5. The first light source 2 and the second light source 3 both are disposed on the supporting unit 1. The first light source 2 includes at least one first lighting unit 21 and a first reflecting unit 22 corresponding in position to the at least one first lighting unit 21. The second light source 3 includes at least one second lighting unit 31 and a second reflecting unit 32 corresponding in position to the at least one second lighting unit 31. The light guiding unit 4 is disposed in front of the supporting unit 1 and the lens 5 is disposed in front of the light guiding unit 4. It is worth mentioning that, the first lighting unit 21 has a first light emitting surface 211 and the second lighting unit 31 has a second light emitting surface 311, and the light emitting direction of the first light emitting surface 211 is opposite to that of the second light emitting surface 311 and the first light emitting surface 211 and the second light emitting surface 311 are coplanar with each other or in the vicinity of a plane. More specifically, the first light emitting surface 211 and the second light emitting surface 311 have a spacing therebetween that is between 0 mm and 5 mm, and preferably between 0 mm and 3.2 mm. Therefore, the light utilization efficiency of the light projecting device P can be increased while satisfying requirements for miniaturization.

The main difference between the present embodiment and the aforesaid embodiments is that the supporting unit 1 has a different structure. In addition, the second light source 3 includes two second lighting unit 31 and the second reflecting unit 32 includes two second reflecting portions 321 that correspond in position to the two second lighting units 31 respectively. Therefore, the illumination strength of the high beam light can be increased. In the present embodiment, the supporting unit 1 includes a partitioning board 11 and a base 13. The base 13 includes a first mounting portion 131 and a second mounting portion 132, and the first mounting portion 131 is closer to the light-shielding unit 4 than the second mounting portion 132. The base 13 has a first surface 13*a* and a second surface 13*b* opposite to the first surface 13*a*. The first mounting portion 131 has a notch 1311 passing through the first surface 13*a* and the second surface 13*b*, and the partitioning board 11 is connected to the first mounting portion 131 and overlaps with the notch 1311. In order to allow lights generated from the first lighting unit 21 and the second lighting unit 31 to respectively emit to the first reflecting unit 22 and the second reflecting unit 32, the partitioning board 11 has a first opening 111 and the second mounting portion 132 has a second opening 1321. The first light emitting surface 211 of the first lighting unit 21 is exposed from the first surface 13*a* through the first opening 111, and the second light emitting surface 311 of the second lighting unit 31 is exposed from the second surface 13*b* through the second opening 1321.

Referring to FIG. 34 to FIG. 38 and FIG. 41 to FIG. 45, the first reflecting unit 22 is disposed on the first mounting portion 131 and on the first surface 13*a*. The first reflecting unit 22 has a reflecting surface (not numbered) with only one curvature or a number of curvatures. The reflecting surface is, for example, a partial ellipsoidal surface or a composite ellipsoidal surface, but is not limited thereto. The first reflecting unit 22 has a first focal point 22*a* and a second focal point 22*b* corresponding in position to the first focal point 22*a*. The first focal point 22*a* is located in a cover area of the first reflecting unit 22, and the second focal point 22*b* is located outside the cover area of the first reflecting unit 22, i.e., at an area between the first reflecting unit 22 and the lens 5. The second focal point 22*b* is located on a lens optical axis 51 and coincides with a lens focal point 51. Also, the second focal point 22*b* can be deviated from the lens optical axis 51 and located in the vicinity of the lens focal point 52. The first lighting unit 21 is disposed on a first circuit board 23. The first lighting unit 21 may be an LED or a package structure including a number of LEDs. The first lighting unit 21 can be disposed on or in the vicinity of the first focal point 22*a*.

The second reflecting unit 32 is disposed on the first mounting portion 131 and on the second surface 13*b*. Each of the two second reflecting portions 221 is part of a light reflecting cup and has a reflecting surface (not numbered) with only one curvature or a number of curvatures. The reflecting surface is, for example, a partial ellipsoidal surface or a composite ellipsoidal surface, but is not limited thereto. Each of the two second reflecting portions 321 has a first focal point 321*a* and a second focal point 321*b* corresponding in position to the first focal point 321*a*. Each first focal point 321*a* is located in a cover area of the corresponding second reflecting portion 321 and each second focal point 321*b* is located at an area in proximity to the lens 5, i.e., an area between the second reflecting unit 32 and the lens 5. More specifically, the two second focal points 321*b* are located on the lens optical axis 51 and coincide with the lens focal point 52. Also, the two second focal points 321*b* can be deviated from the lens optical axis 51 and located in the vicinity of the lens focal point 52. The two second lighting units 31 are disposed on a second circuit board 33. Each of the two second lighting units 31 may be an LED or a package structure including a number of LEDs. The two second lighting units 31 can be respectively disposed on or in the vicinity of the two first focal points 321*a*.

Referring to FIG. 34 to FIG. 38 and FIG. 41 to FIG. 45, the heat dissipating assembly 12 includes a plurality of heat dissipating fins 123, a heat conducting cylinder 124, a heat pipe 125 and a heat conducting strip 126. The second mounting portion 132 of the base 13 has a connecting structure 1322 that can be an annular connecting member, but is not limited thereto. The connecting structure 1322 is connected to a frond end of the heat conducting cylinder 124. The heat conducting cylinder 124 has an outer peripheral surface 1241 and a heat dissipation space 1242. The heat dissipating fins 123 are disposed on the outer peripheral surface 1241 at predetermined intervals. The heat pipe 125 is disposed below the base 13 and extends into the heat dissipation space 1241 along a length direction of the base 13. The heat conducting strip 126 is disposed on the heat pipe 125 and extends into the heat dissipation space 1241 from the second opening 1321. The extension directions of the heat dissipating fins 123 are substantially perpendicular to the length directions of the heat conducting cylinder 124, the heat pipe 125 and heat conducting strip 126. The first circuit board 23 is disposed at a front end of the heat pipe 125. The second circuit board 33 is disposed in the vicinity of the second opening 1321 and connected to a front end of the heat conducting strip 126. Therefore, heat generated from the first lighting unit 21 can be directly transmitted to the heat pipe 125, and uniformly transmitted to the heat dissipating fins 123 by the heat conducting strip 126 and the heat conducting cylinder 124 so as to be quickly dissipated to an outer environment. Similarly, heat generated from the second lighting unit 31 can be directly transmitted to the heat conducting strip 126, and uniformly transmitted to the heat dissipating fins 123 by the heat pipe 125 and the heat conducting cylinder 124 so as to be quickly dissipated to the outer environment.

In the present embodiment, the lens 5 is connected to the first mounting portion 131 of the base 13 by a lens holder 6.

More specifically, the first mounting portion 131 of the base 13 has two connecting arms 1312 on a front end thereof. The lens holder 6 includes a frame body 61 and two supporting arms 62. The frame body 61 is configured to retain the lens 5. The two supporting arms 62 extend from the frame body 61 to respectively connect to the two connecting arms 1312. In addition, the light guiding unit 4 can be an opaque light guiding plate or a transparent light guiding block, and is fixed between the two supporting arms 62 and on the two connecting arms 1312. In addition, the light projecting device P can be mounted on a vehicle light source (not shown) by a mounting unit 7.

It is worth mentioning that, based on the optical designs according to the embodiments of the present disclosure, the number of the first lighting unit of the first light source or the second lighting unit of the second light source can be increased to two or more, so as to increase the illumination strength of the low beam or high beam light.

One of the advantages of the present disclosure is that the light projecting device, in which the light emitting direction of the first light emitting surface is opposite to that of the second light emitting surface and the first light emitting surface is coplanar with the second light emitting surface, can have high light utilization efficiency while satisfying requirements for miniaturization.

Furthermore, the light guiding unit can be a transparent light guiding block, the bottom surface of which is coplanar with the second light emitting surface. Therefore, the dark area between the low beam and high beam illumination patterns can be reduced. That is to say, the dark area between the low beam and high beam illumination patterns becomes less visible.

Furthermore, the light guiding unit can be a transparent light guiding block, the bottom surface of which has a light reflecting layer thereon. Therefore, the dark area between the low beam and high beam illumination patterns can be eliminated.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A light projecting device having high light utilization efficiency, comprising:

a supporting unit including a partitioning board and a heat dissipating assembly, and the partitioning board has a first supporting surface and a second supporting surface located at the two opposite sides thereof, wherein the heat dissipating assembly includes:

a heat conducting board including a first heat transmitting surface and a second heat transmitting surface opposite to the first heat transmitting surface;

a heat conducting column disposed on the first heat transmitting surface; and a plurality of heat dissipating fins disposed on the second heat transmitting surface at intervals;

a first light source disposed on the supporting unit and including at least one first lighting unit, at least one first circuit board for disposing the at least one first lighting unit and a first reflecting unit corresponding in position to the at least one first lighting unit, wherein the at least one first lighting unit has a first light emitting surface and the at least one first circuit board is disposed on the first supporting surface and close to the heat conducting column;

a second light source disposed on the supporting unit and including at least one second lighting unit, at least one second circuit board for disposing the at least one second lighting unit and a second reflecting unit corresponding in position to the at least one second lighting unit, wherein the at least one second lighting unit has a second light emitting surface, and the at least one second circuit board is disposed on the first heat transmitting surface and connected to the at least first circuit board by an electrically connecting structure;

a light guiding unit disposed in front of the supporting unit to guide lights projected from the first light source and the second light source to a lens; and the lens disposed in front of the light guiding unit to allow lights passing via the light guiding unit to project outwardly so as to produce a high beam or low beam illumination pattern;

wherein the light emitting direction of the first light emitting surface is opposite to that of the second light emitting surface, and the first light emitting surface is substantially coplanar with the second light emitting surface.

2. The light projecting device according to claim 1, wherein the first light emitting surface and the second light emitting surface has a vertical distance therebetween that is between 0 mm and 5 mm.

3. The light projecting device according to claim 1, wherein the lens has a lens optical axis that is in the vicinity of the first light emitting surface and the second light emitting surface.

4. The light projecting device according to claim 1, wherein the lens has a lens optical axis that passes through the first light emitting surface and the second light emitting surface.

5. The light projecting device according to claim 1, wherein the partitioning board has at least one first opening and at least one second opening which pass through the first supporting surface and the second supporting surface, wherein the first reflecting unit is disposed on the first supporting surface and the first lighting unit is disposed in the vicinity of the second supporting surface, the first light emitting surface is exposed from the first supporting surface through the first opening, the second reflecting unit is disposed on the second supporting surface and the second lighting unit is disposed in the vicinity of the first supporting surface, and the second light emitting surface is exposed from the second supporting surface through the second opening.

6. The light projecting device according to claim 5, wherein the light guiding unit is an opaque light guiding plate that extends along a length direction of the partitioning board, and the light guiding plate has a top surface located at the same side as the first supporting surface of the partitioning board.

7. The light projecting device according to claim 6, wherein the top surface includes a first flat surface, a second flat surface and an oblique surface, the first flat surface is located higher than the second flat surface, and the oblique surface is connected between the first flat surface and the second flat surface.

8. The light projecting device according to claim 6, wherein the light guiding plate is integrated with the partitioning board.

9. The light projecting device according to claim 1, wherein the light guiding unit is a light guiding block that is light-permeable and extends along a thickness direction of the partitioning board, and the light guiding block has a bottom surface located at the same side as the second supporting surface of the partitioning board.

10. The light projecting device according to claim 9, wherein the bottom surface of the light guiding block includes a first flat surface, a second flat surface and an oblique surface, the first flat surface is located higher than the second flat surface, and the oblique surface is connected between the first flat surface and the second flat surface.

11. The light projecting device according to claim 9, wherein the light guiding block and the partitioning board has a predetermined distance therebetween that is between 0.01 mm and 1 mm.

12. The light projecting device according to claim 9, wherein the bottom surface of the light guiding block is substantially coplanar with the first light emitting surface and the second light emitting surface.

13. The light projecting device according to claim 9, wherein the bottom surface of the light guiding block has a light reflecting layer formed thereon.

14. The light projecting device according to claim 1, wherein the supporting unit further includes a heat dissipating assembly, the heat dissipating assembly includes a heat conducting board, a heat conducting column and a plurality of heat dissipating fins, the heat conducting board includes a first heat transmitting surface and a second heat transmitting surface opposite to the first heat transmitting surface, the heat conducting column is disposed on the first heat transmitting surface, and the heat dissipating fins are disposed on the second heat transmitting surface at intervals, wherein the first light source further includes at least one first circuit board for disposing the first lighting unit, and the first circuit board is disposed above the first supporting surface and in the vicinity of the heat conducting column, wherein the second light source further includes at least one second circuit board for disposing the second lighting unit, and the second circuit board is disposed on the first heat transmitting surface, and wherein the first circuit board and the second circuit board are in electrical connection by an electrically connecting structure disposed therebetween.

15. The light projecting device according to claim 14, wherein the second circuit board has a surface that is distant from the first supporting surface and has a first vertical distance relative to the first light emitting surface, and the first vertical distance is less than 15 mm.

16. The light projecting device according to claim 1, wherein the second circuit board has a lateral surface distant from the lens, the first lighting unit has a lateral surface facing the lens, and the lateral surfaces of the second circuit board and the first lighting unit has a second vertical distance therebetween that is less than 15 mm.

17. The light projecting device according to claim 1, wherein the supporting unit includes a base and a partitioning board, the base has a first surface and a second surface opposite to the first surface and includes a first mounting portion and a second mounting portion, the first mounting portion is closer to a light-shielding unit than the second mounting portion, the first mounting portion has a notch passing through the first surface and the second surface, the partitioning board is connected to the first mounting portion and overlaps with the notch, and wherein the partitioning board has at least one first opening and the first light emitting surface of the first lighting unit is exposed from the first surface through the first opening, and the second mounting portion has at least one second opening and the second light emitting surface of the second lighting unit is exposed from the second surface through the second opening.

* * * * *